United States Patent [19]

Kato et al.

[11] Patent Number: 5,073,803

[45] Date of Patent: Dec. 17, 1991

[54] COPYING APPARATUS PROVIDED WITH AN AUTOMATIC DOCUMENT FEEDER AND A SHEET BINDING UNIT

[75] Inventors: Tomokazu Kato; Syuzi Maruta; Masazumi Ito; Kadotaro Nishimori; Kimihiko Higashio, all of Osaka, Japan

[73] Assignee: Minolta Camera Kabushiki Kaisha, Osaka, Japan

[21] Appl. No.: 451,235

[22] Filed: Dec. 15, 1989

[30] Foreign Application Priority Data

Dec. 17, 1988 [JP] Japan ..... 63-319292
Nov. 18, 1989 [JP] Japan ..... 1-300595

[51] Int. Cl.[5] ..... G03G 21/00

[52] U.S. Cl. ..... 355/324; 270/37; 270/53; 355/24; 355/313; 355/319

[58] Field of Search ..... 355/204, 208, 308, 313, 355/319, 324, 24; 270/37, 53

[56] References Cited

U.S. PATENT DOCUMENTS

| | | | |
|---|---|---|---|
| 4,134,672 | 1/1979 | Burlew et al. | 355/324 |
| 4,330,197 | 5/1982 | Smith et al. | 355/319 |
| 4,558,942 | 12/1985 | Chiama | 270/53 X |
| 4,568,172 | 2/1986 | Acquaviva | 355/324 X |
| 4,586,640 | 5/1986 | Smith | 270/53 X |
| 4,607,948 | 8/1986 | Naito | 355/319 X |
| 4,724,460 | 2/1988 | Shinyashiki | 355/308 |
| 4,811,048 | 3/1989 | Ishikawa et al. | 355/323 |

FOREIGN PATENT DOCUMENTS

| | | | |
|---|---|---|---|
| 0205466 | 10/1985 | Japan | 355/324 |
| 0116167 | 5/1988 | Japan | 355/324 |
| 0116169 | 5/1988 | Japan | 355/324 |

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

A copying apparatus includes a circulating type original document feeder for feeding a plurality of originals from a tray, one by one, onto an exposure section. Each original is exposed to light from an optical system and an image of each original is copied onto a sheet. The apparatus also includes a counter for counting the number of originals fed from the feeder, a binding unit for binding sheets, and a controller for inhibiting the operation of the binding unit when the value counted by the counter is over a standard. The feeder may operate in a first feeding mode where each original is fed to the exposure section with only its first side facing the optical system, or in a second feeding mode where each original is fed twice to the exposure section, once with its first side facing the optical system and then once with its other side facing the optical system. The apparatus also operates in a first copying mode where each sheet is subjected to only one copying operation, and a second copying mode where each sheet is subjected to a plurality of copying operations. An operation mode is selected from a combination of one of the two feeding modes and one of two copying modes. A standard is then determined according to the selection of the operation mode in order to prevent the binding unit from receiving a number of sheets in excess of its storage capacity.

3 Claims, 26 Drawing Sheets

COPYING APPARATUS PROVIDED WITH AN AUTOMATIC DOCUMENT FEEDER AND A SHEET BINDING UNIT

BACKGROUND OF THE INVENTION

1. Field of the Invention

The present invention relates to a copying apparatus, and more specifically, to an electrophotographic copying apparatus provided with an automatic document feeder and a finisher having a function of binding copies.

2. Description of the Related Art

Recently, in reference to an electrophotographic copying apparatus, users have been demanding for the automation of handling originals and copy sheets. At the request, an automatic document feeder for feeding a stack of originals onto an original glass one after another and discharging the originals from the original glass serially after the image exposure, a finisher for stacking and aligning copies automatically and stapling the copies with an electric stapler and so on have been provided in various types.

Incidentally, such a finisher has a limitation in stapling copies, and a stapling tray is limited in capacity in accordance with the limitation of the finisher. In the meantime, an automatic document feeder has a capacity to handle more originals at one time than copies to be handled by the finisher. For example, in a copying apparatus provided with a stapling tray which has a storing capacity of 30 and an automatic document feeder which has a handling capacity of 50, when more than 30 originals are to be copied, a stapling mode should be canceled to eject copies onto an ordinary sheet tray.

Also, these days, a type of automatic document feeder having a function of tuning over originals has been developed, and in a copying apparatus provided with such an automatic document feeder, when the images on the both sides of each original are to be copied on different sheets, 15 originals will produce 30 copies which is the limitation of the finisher. On the other hand, when two images of two originals are copied onto the both sides of a copy sheet, 30 originals will be produce only 15 copies.

Therefore, the judgment of availability of the staping operation based on only the number of originals will fail to follow the recent image handling in various operation modes.

SUMMARY OF THE INVENTION

Therefore, the present invention proposes a copying apparatus wherein it is judged from a count of originals fed by an automatic document feeder whether copies to be transported to a binding means will be more than or less than the capacity of the binding means, and the standard of the judgment is changeable depending on operation mode.

Here, an operation mode indicates such a mode as a single side original feeding mode, a duplex original feeding mode in reference to the automatic document feeder and a single side copying mode, a duplex copying mode and a composite copying mode in reference to the copying machine. Suppose the number of times of image forming operations to which one copy sheet is subjected to be "M" and the binding capacity of the binding means to be "N". When the operation mode is a combination of the single side original feeding mode with the single side copying mode, the standard is "N". When it is a combination of the duplex original feeding mode with either the duplex copying mode or the composite copying mode, the standard is "N×M". When it is a combination of the duplex original feeding mode with the single side copying mode, the standard is "N/2". When it is a combination of the duplex original feeding mode with either the duplex copying mode or the composite copying mode, the standard is "N×M/2".

The standard is altered every time an operator determines an operation mode. The number of originals is counted by the automatic document feeder in advance of a copying operation, and the count value is compared with the standard.

When the number of originals is over the standard, a binding mode is canceled, so that copies will be received in a place other than the binding means such as a sheet tray. On the other hand, the number of originals is under the standard, the binding mode is maintained. Therefore, in any operation mode, in case it is detected that copies will be over the capacity of the binding means, thereby preventing troubles which may occur in collecting and binding copies.

BRIEF DESCRIPTION OF THE DRAWINGS

These and other objects and features of the present invention will become apparent from the following description taken in conjunction with the preferred embodiment thereof with reference to the accompanying drawings.

The accompanying drawings show an embodiment of a copying apparatus according to the present invention.

DETAILED DESCRIPTION OF THE PREFERRED EMBODIMENT

An embodiment of a copying apparatus according to the present invention is hereinafter described in reference to the accompanying drawings.

General Constitution Apparatus

Figure 1:
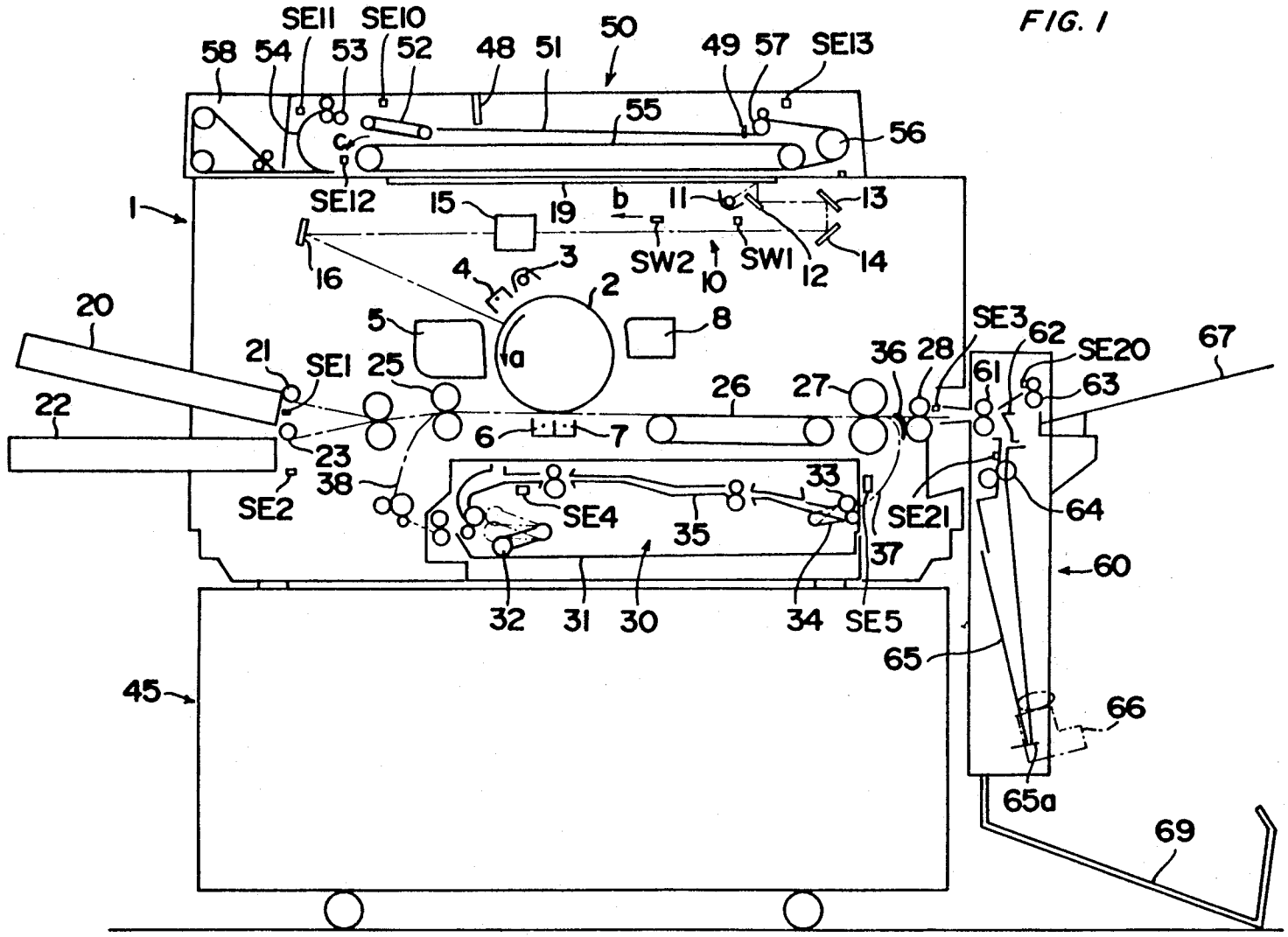
FIG. 1 is a schematic view of the whole apparatus showing the constitution.

As shown in FIG. 1, a copying machine 1 is mounted on a desk 45, and a circulating type of automatic document feeder 50 (which will be hereinafter referred as RDH) is mounted over the copying machine 1. A finisher 60 with a function of stapling copies is provided on the right side of the copying machine 1.

Copying Machine

A photosensitive drum 2 which rotates in the direction of the arrow a is installed in the copying machine 1. Around the photosensitive drum 2, an eraser lamp 3, an electric charger 4, a developing device 5 taking which may have an electric brush, a transfer charger 6, a charger remover 7, a cleaning device 8 which may use a blade, etc. are arranged in order along the rotating direction of the photosensitive drum 2. Further, the constitution and the operation of these image forming elements are so well-known that the detailed description is omitted.

An optical system 10 comprises an exposure lamp 11, movable mirrors 12, 13 and 14, a projection lens 15, and a fixed mirror 16. The exposure lamp 11 and the movable mirror 12 are movable in the direction of the arrow b in a body at a speed of v/m (v: peripheral speed of the photosensitive drum 2, m: magnification rate), and the movable mirrors 13 and 14 are movable in the direction of the arrow b in a body at a speed of v/2 m. An original is placed on an original glass 19 as described later, and the original image is subjected to slit exposure by the movement of the optical system 10 in the direction of the arrow b and projected onto the photosensitive drum 2. Also, a standard position switch SW1 and a timing switch SW2 for detecting the optical system 10 are provided. The standard position switch SW1 detects whether or no the optical system 10 is standing by at a scan starting position. The timing switch SW2 generates a signal which becomes a reference of the timing of feeding a copy sheet to the transfer section.

In the meantime, copy sheets are fed one after another out of a feed cassette either 20 or 22 by the rotation of a feed roller 21 or 23, and each sheet is fed to the transfer section by timing rollers 25 in synchronization with an image formed on the photosensitive drum 2. After the transference of the image, the sheet is transported to the fixing device 27 by a conveyer belt 26 having air suction means. After the fixation of the image, the sheet is ejected from the copying machine 1 by ejection rollers 28. Sheet size detection sensors, which are not shown in the drawings, are disposed at respective places where the cassettes 20 and 22 are fitted to the copying machine 1. The sensors change their conditions depending on arrangement or position of projections, magnets or the like which are provided with the cassettes 20 and 22, so that the sizes of sheets loaded in the cassettes 21 and 22 are judged from a specified code by a control section. Also, the presence or the absence of sheets in the cassettes 20 and 22 are detected by sensors SE1 and SE2 respectively sheets ejected from the copying machine 1 are detected by a sensor SE3.

A refeeding unit 30 is installed in the copying machine 1 so that duplex and composite copying operations are available. The refeeding unit 30 comprises an intermediate tray 31 provided with refeed rollers 32, transport rollers 33, a diverting member 34, and a turn-over path 35 composed of transport rollers and guide plates. A sheet detection sensor SE4 is disposed besides the turn-over path 35, and another sheet detection sensor SE5 is disposed at the entrance of the refeeding unit 30. Also, immediately before the ejection rollers 28, a diverting member 36 is disposed, and a path 37 leads to the unit 30. In a case of either duplex copying or composite copying, a sheet which gained an image on one side is guided into the path 37 by the diverting member 36. In a case of duplex copying, the diverting member 34 is positioned as shown in the solid line, and the sheet passes through the turn-over path 35. Subsequently, the sheet is received on the intermediate tray 31 with its printed side up. In a case of composite copying, the diverting member 34 is positioned as shown in the dashed line, so that the sheet is received on the intermediate tray 31 with its printed side down. In feeding sheets out of the tray 31, the refeed rollers 32 are rotated, and the sheets are fed out of the tray 31 one after another into a refeeding path 38 which leads to the timing rollers 25.

Automatic Document Feeder

The RDH 50 comprises an original table 51, a feed belt 52, a plurality of feed rollers 53, a guide plate 54, a conveyer belt 55, a discharge guide roller 56, discharge rollers 57, and a turn-over section 58 composed of rollers, guide plates, etc. The RDH 50 feeds a set of originals circularly in order from the last page. A set of originals are placed on the original table 51 in a state that the first page and the last page are the topmost and the bottom of the stack respectively and all the originals are put their imaged sides up. Then, the originals are fed out of the table 51 by the rotation of the feed belt 52, starting with the last page, and each of them is guided by the guide plate 54 and fed between the conveyer belt 55 rotating in the direction of the arrow c and the original glass 19. By the rotation of the conveyer belt 55, the original is set to a specified position on the original glass 19 to be exposed to light from the optical system 10. After the exposure, the original is transported from the original glass 19 toward the right in FIG. 1 by the conveyer belt 55, and the original is received on the original table 51 with its imaged side up through the discharge guide roller 56 and the discharge rollers 57.

On the original table 51, a stopper 48 and an original pushing board 49 are disposed. The stopper 48 divides the originals which have been put thereon from the originals which were copied and returned thereto. The originals which were discharged from the original glass 19 and returned to the original table 51 are stacked thereon with their leading edges regulated by the stopper 48. When all the originals are returned to the original table 51, the stopper 48 retreats from the regulating position, and the pushing board 49 moves toward the left in FIG. 1 to push the originals to the position where the leading edges of the originals are placed on the feed belt 52. Thus, the set of originals get ready for the next cycle.

When an original having images on both sides (which is hereinafter referred to as a duplex original) is to be copied, it is fed onto the original glass 19 as described above so that the image on the front side can be copied, and thereafter the conveyer belt 55 is rotated in the reverse direction of the arrow c to convey the original to the turn-over section 58. Then, the original is here turned over and fed onto the original glass 19 again so that the image on the reverse side can be copied. Thus, the images on both sides of a duplex original can be automatically copied onto two sheets, or copied onto both sides of a sheet by operating the duplex copying function.

Further, the RDH 50 is provided with a sensor SE10 for detecting whether or not any original is set on the original table 51 and sensors SE11, SE12 and SE13 for checking the circulation of originals. The number of originals are counted based on the detection of each original by the sensor SE11. Further, the RDH 50 can be pulled up on the back side of the copying machine 1, so that it also functions as an ordinary original cover when an original is set on the original glass 19 manually.

Finisher

The finisher 60 has a function of stacking copies on a tray 67, and a function of stacking copies in a tray 65 and thereafter stapling the stack of copies by an electric stapler 66. Travel of sheets is diverted by a diverting member 62, and when the finisher 60 is operated in an ejection mode, copies which passed through receiving rollers 61 are transmitted to ejection rollers 63 and received on the tray 67. When it is operated in a stapling mode, copies are guided downward by the diverting member 62 and received in the stapling tray 65 through storing rollers 64. The copies which have been stored and aligned in the stapling tray 65 are stapled by the electric stapler 66, and thereafter when a stopper 65*a* at the bottom of the tray 65 is open, the stapled copies fall into a stack box 69.

Also, sensors SE20 and SE21 are disposed immediately before the ejection rollers 63 and the storing rollers 64 respectively, and each of the sensors detects a sheet passing.

Operation Mode

With the constitution above, the copying machine 1 is operable selectively in either a single side copying mode, a duplex copying mode or a composite copying mode. The RDH 50 is operable selectively in either a single side original feeding mode or a duplex original feeding mode. The finisher 60 is operable selectively in either an ejection mode or a stapling mode.

Further, for the assortment of copies, a sorting mode and a grouping mode are available. In the sorting mode, a whole copy set of a set of originals is divided from other sets. In this embodiment, a set of originals is circulated once by the RDH 50 so that all the originals can be copied once, and this one cycle of copying operation is repeated by the number of times predetermined by an operator. When the finisher 60 is further operated in the stapling mode, copies are transported into the stapling tray 65, and every time one cycle of copying operation is completed, the copies are stapled. In the grouping mode, each original in a set is exposed to light to make a predetermined number of copies, and copies of an original are serially transported to either the tray 65 or 67. In reference to a stapling operation in this case, every time the predetermined number of copies of one original are stored in the stapling tray 65, the copies are stapled.

Accordingly, in this embodiment, when single side originals whose number is "L" are copied in the single side copying mode, the number of copies to be gained is "L". When these originals are copied in either the duplex copying mode or the composite copying mode, the number of copies to be gained is "L/2". When duplex originals whose number is "L" are copied in the single side copying mode, the number of copies to be gained is "2L". When these originals are copied in either the duplex copying mode or the composite copying mode, the number of copies to be gained is "L". Suppose the number of copies to be stapled is limited to 30. When single side originals are copied in the single copying mode, or when duplex originals are copied in either the duplex or the composite copying mode, 30 originals is the limit. When single side originals are copied in either the duplex or the composite copying mode, 60 originals ($2\times30$) is the limit. When duplex originals are copied in the single side copying mode, 15 originals (30/2) is the limit. Accordingly, in this embodiment, prior to a copying operation, the RDH 50 is operated to count the number of originals to be fed. When the number of originals is over the stapling capacity, which is judged from the combination of type of original and copying modes, the stapling mode is canceled so that copies can be ejected onto the tray 67.

Control Panel

Figure 2:
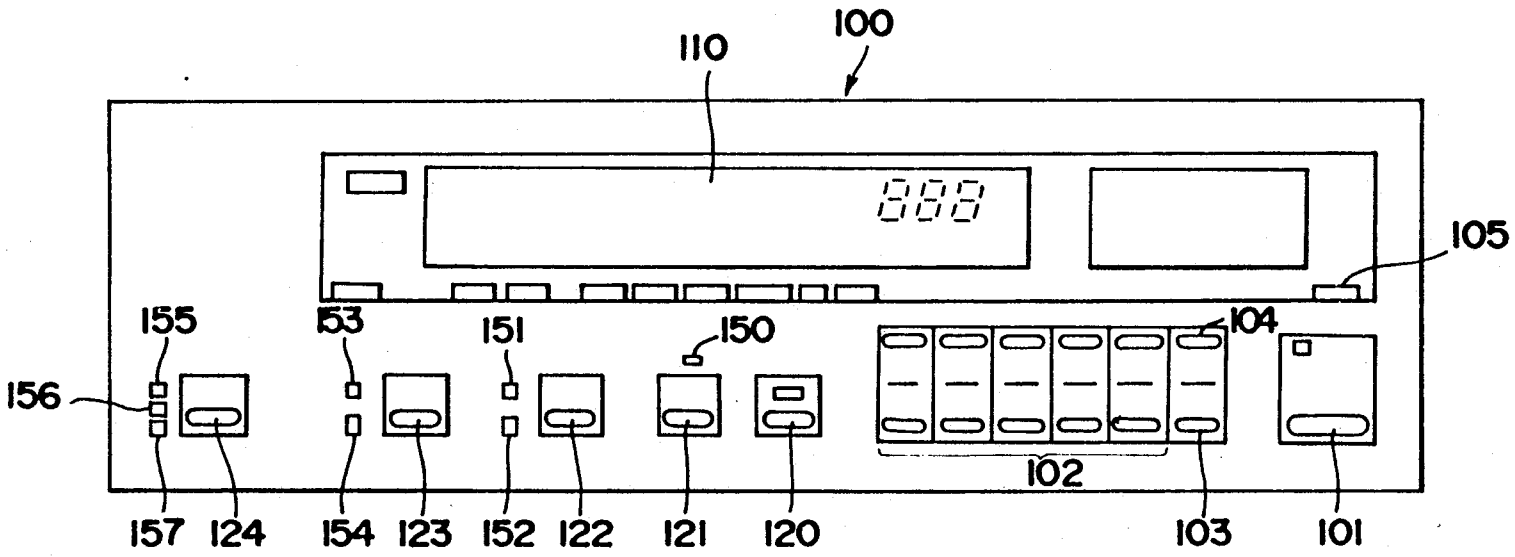
FIG. 2 is a plan view of a control panel.

FIG. 2 shows a control panel 100 disposed on the copying machine 1, and the control panel 100 comprises the following keys and indicating means.

Numeral 101 is a print key for starting a copying operation. Numeral 102 is a ten-key for setting the number of copies to be made. Numeral 103 is an interruption key for executing an interrupt copying operation. Numeral 104 is a clear/stop key for clearing the number set with the ten-key 102 and stopping a multiple copying operation. Numeral 105 is an all reset key for resetting the copying mode to the initial state. Numeral 110 is a fluorescent indication tube for indicating a set number, a place where a paper jam occurs, etc. Numeral 120 is a feed port selection key. Numeral 121 is a stapling mode selection key. Numeral 150 is an LED for indicating that the stapling mode has been selected. Numeral 122 is a sorting/grouping mode selection key. Numeral 151 is an LED for indicating that the sorting mode has been selected. Numeral 152 is an LED for indicating the grouping mode has been selected. Numeral 123 is an original feeding mode selection key. Numeral 153 is an LED for indicating that the single side original feeding mode has been selected. Numeral 154 is an LED for indicating that a duplex original feeding mode has been selected. Numeral 124 is a copying mode selection key. Numeral 155 is an LED for indicating that the single side copying mode has been selected. Numeral 156 is an LED for indicating that the duplex copying mode has been selected. Numeral 157 is an LED for indicating that the composite copying mode has been selected.

Control Circuits

Figure 3A:
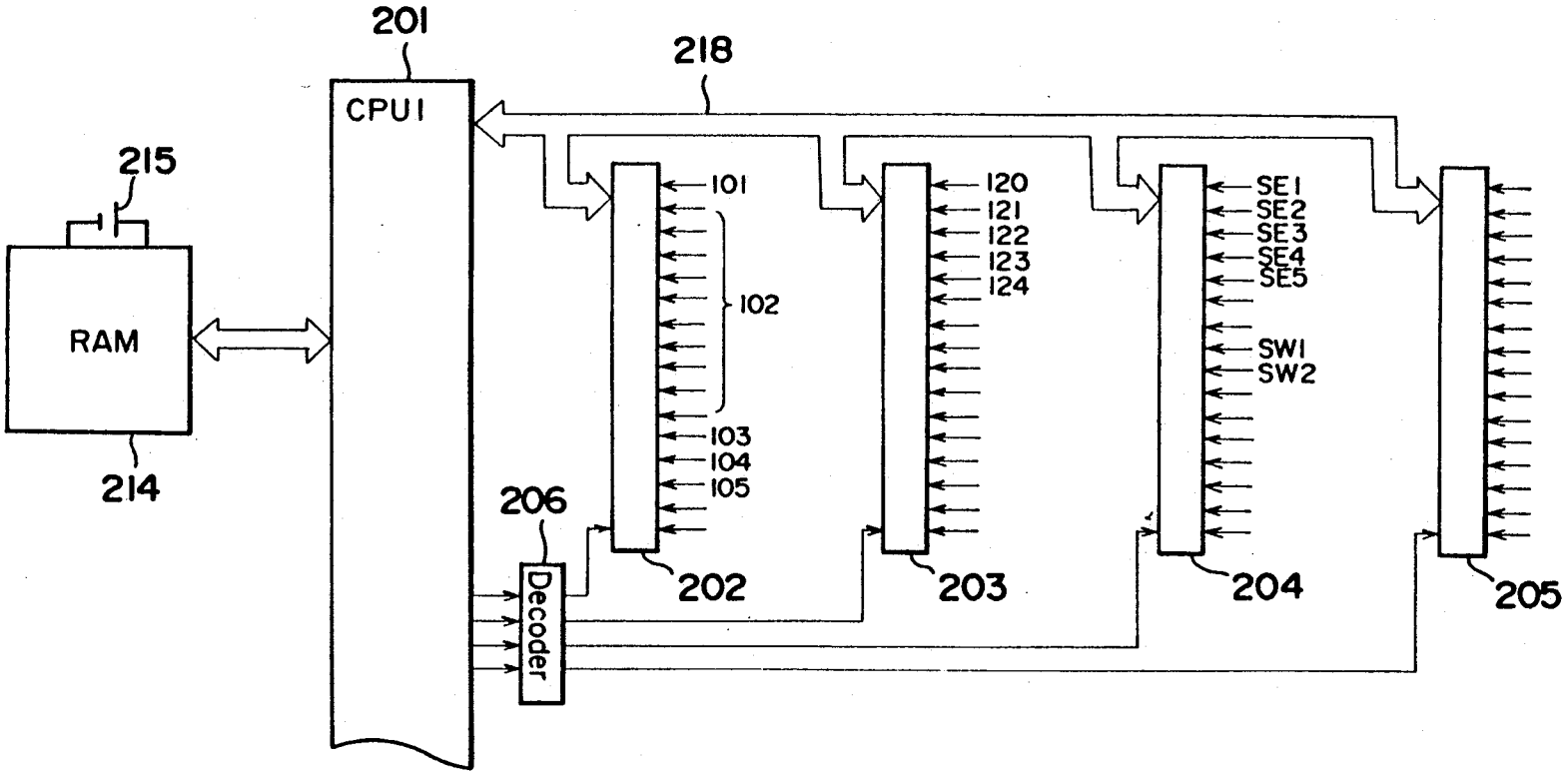
FIGS. 3*a* and 3*b* are block diagrams of a control circuit of a microcomputer which controls a copying machine.
Figure 3B:
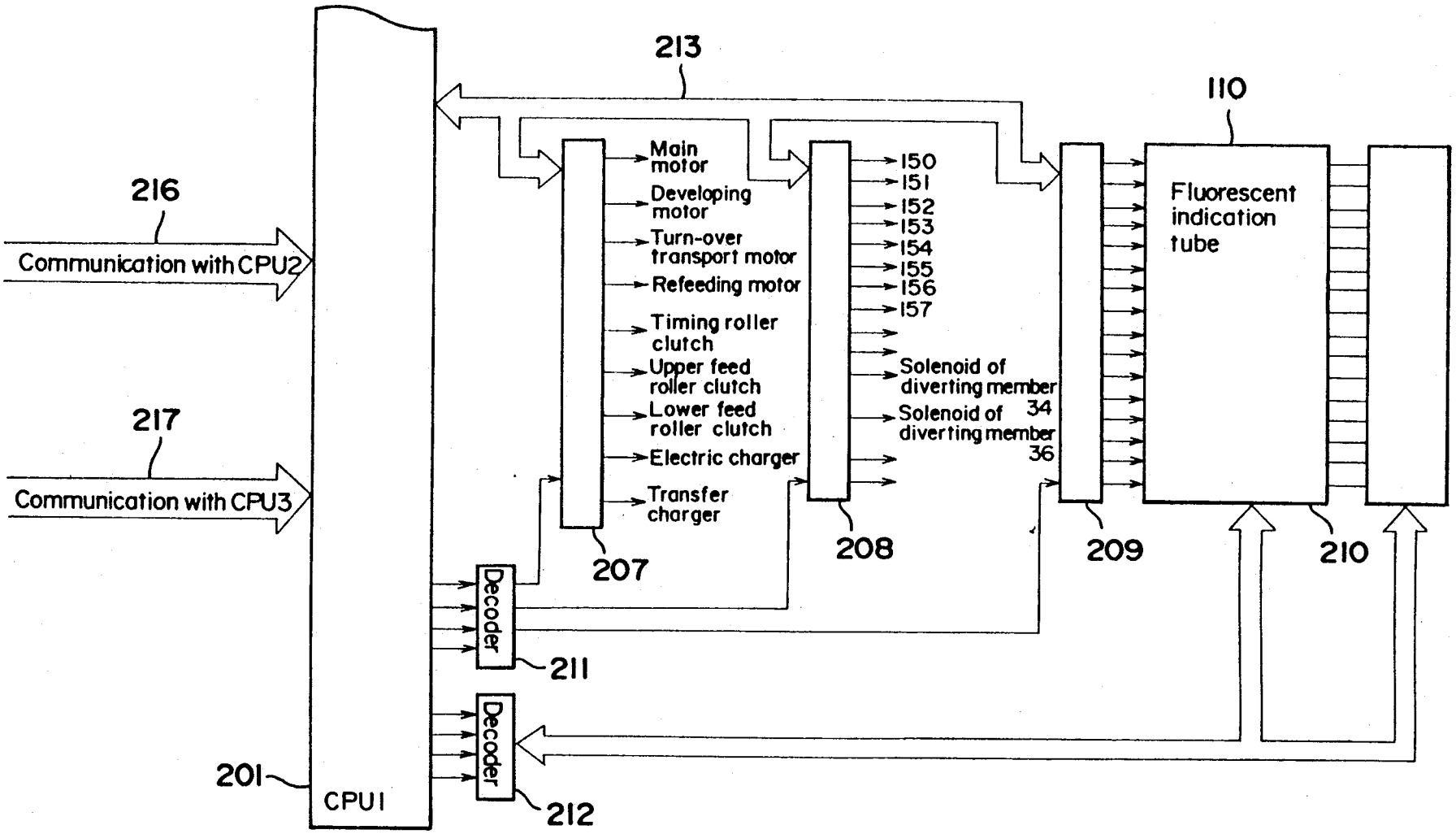

FIGS. 3*a* and 3*b* show the constitution of input and output of a first CPU 201 controlling the copying machine 1. Numerals 202 through 205 and 207 through 209 denote ICs for expanding input and output. Various keys, switches and sensors are connected with ICs 202 through 205 for the input of signals generated therefrom. The ICs 202 through 205 are connected to the CPU 201 by a data line 218 and controlled through a decoder 206. ICs 207 through 209 are connected with all the image forming elements in the copying machine 1, the copy sheets transport system, the LEDs and the fluorescent indication tube 110 in order to transmit signals to them. The ICs 207 through 209 are connected to the CPU 201 by a data line 213 and controlled through a decoder 211. The fluorescent indication tube 110 and an LED matrix 210 for indicating the other things are controlled through a decoder 212. A RAM 214 is connected to the CPU 201 and backed up by a battery 215. Buses 216 and 217 are telecommunication lines with the other CPUs 250 and 260.

Figure 4:
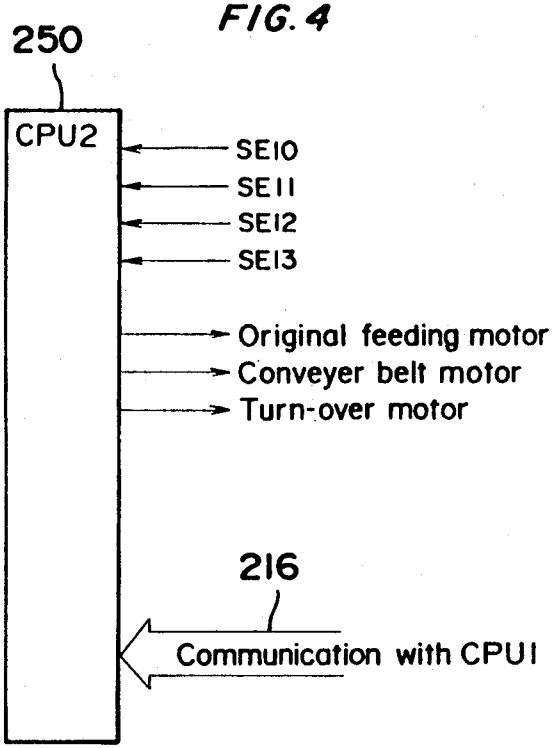
FIG. 4 is a block diagram of a control circuit of a microcomputer which controls an automatic document feeder.

FIG. 4 shows the constitution of input and output of the second CPU 250 controlling the RDH 50. Signals generated from the original detection sensors SE10 through SE13 are entered into the second CPU 250, and signals are transmitted therefrom to a motor of the feed belt 52 and the feed rollers 53, a motor of the conveyer belt 55, a motor of the turn-over section 58, etc.

Figure 5:
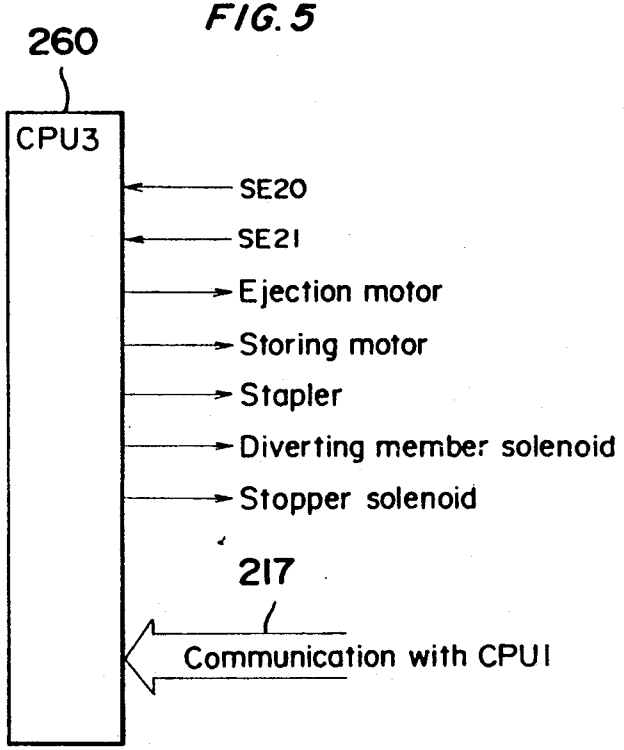
FIG. 5 is a block diagram of a control circuit of a microcomputer which controls a finisher.

FIG. 5 shows the constitution of input and output of the third CPU 260 controlling the finisher 60. Signals generated from the copy sheet detection sensors SE20 and SE21 are entered into the third CPU 260, and signals are transmitted therefrom to a motor of the transport system for ejecting sheets onto the tray 67, a motor of the transport system for transporting sheets into the stapling tray 65, the electric stapler 66, etc.

Control Procedures

Procedures of controlling the copying machine 1, the RDH 50 and the finisher 60 under the above-described control circuits are hereinafter described in reference to the flowcharts shown by figures in and after 6.

In the following paragraphs, the word "on-edge" means a state that a switch, a sensor, a signal or the like is changing from off to on, and the word "off-edge" means a state that a switch, a sensor, a signal or the like is changing from on to off. Also, each of the above-described sensors is turned on when it detects a leading edge of a copy sheet or an original, and turned off when it detects a trailing edge of a copy sheet or an original.

Control Procedure of the Copying Machine

Figure 6:
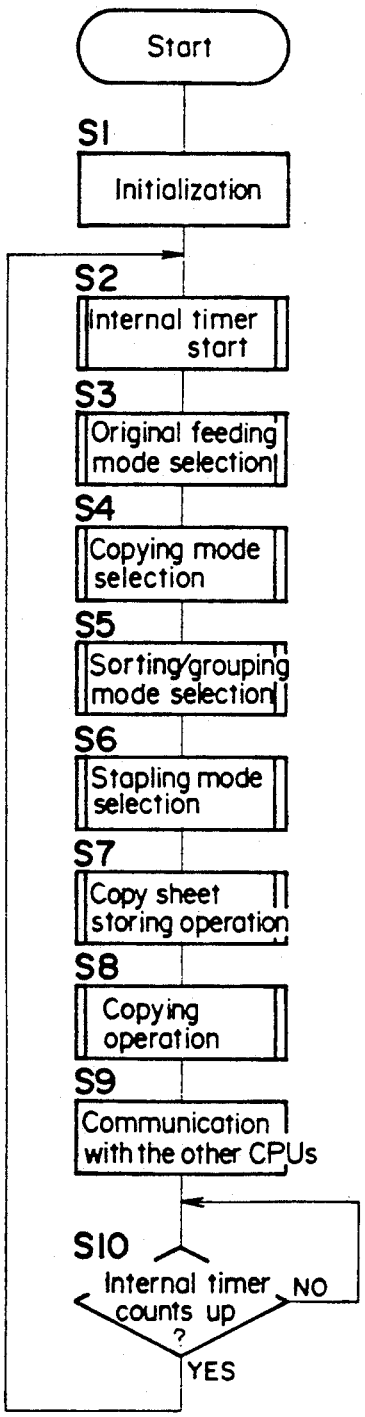
FIG. 6 is a flowchart showing a main routine of the microcomputer which controls the copying machine.

FIG. 6 shows a main routine of the first CPU 201 controlling the copying machine 1.

When the CPU 201 is reset to start a program, first at step S1, the RAM 214 is cleared, every register is initialized, and every device is set to the initial mode. Next, at step 82 an internal timer is started the internal timer determines a time required for one cycle of the main routine, and the value is predetermined at step S1

Subsequently, subroutines are called at steps S3 through S8 in order, and the CPU 201 communicates with the other CPUs 250 and 260 at step S9. The subroutines to be executed at steps S3 through S8 will be explained in detail later. After waiting the internal timer's counting up at step S1O, the processing returns to step S2. The time required for one cycle of this main routine is used for determining a time to be counted by a timer for each subroutine.

Figure 7:
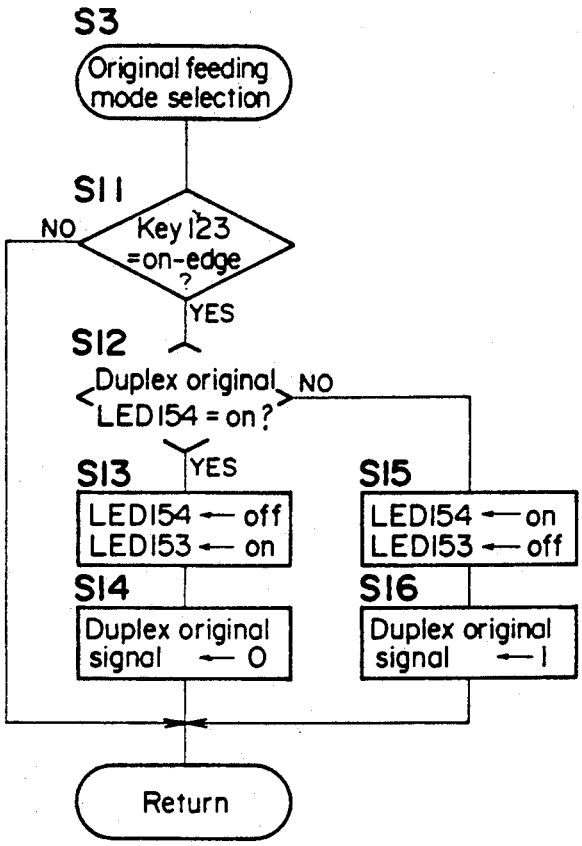
FIG. 7 is a flowchart showing a subroutine for selecting an original feeing mode.

FIG. 7 shows a subroutine for selecting an original feeding mode with the original feeding mode selection key 123, which is executed at step S3.

First, the original feeding mode selection key 123 is checked whether on-edge or not at step S11. When it is on-edge, at step S12 the duplex original feeding mode LED 154 is checked whether on or not, that is, it is checked whether or not the current operation has been performed in the duplex original feeding mode. When the LED 154 is on, at step S13 the LED 154 is turned off, and the single side original feeding mode LED 153 is turned on. Subsequently, at step S14, a duplex original signal to be transmitted to the second CPU 250 is reset to "0". On the other hand, when the LED 154 is judged off at step S12, at step S15 the LED 154 is turned on, and the LED 153 is turned off. Subsequently, at step S16 the duplex original signal is set to "1".

Figure 8:
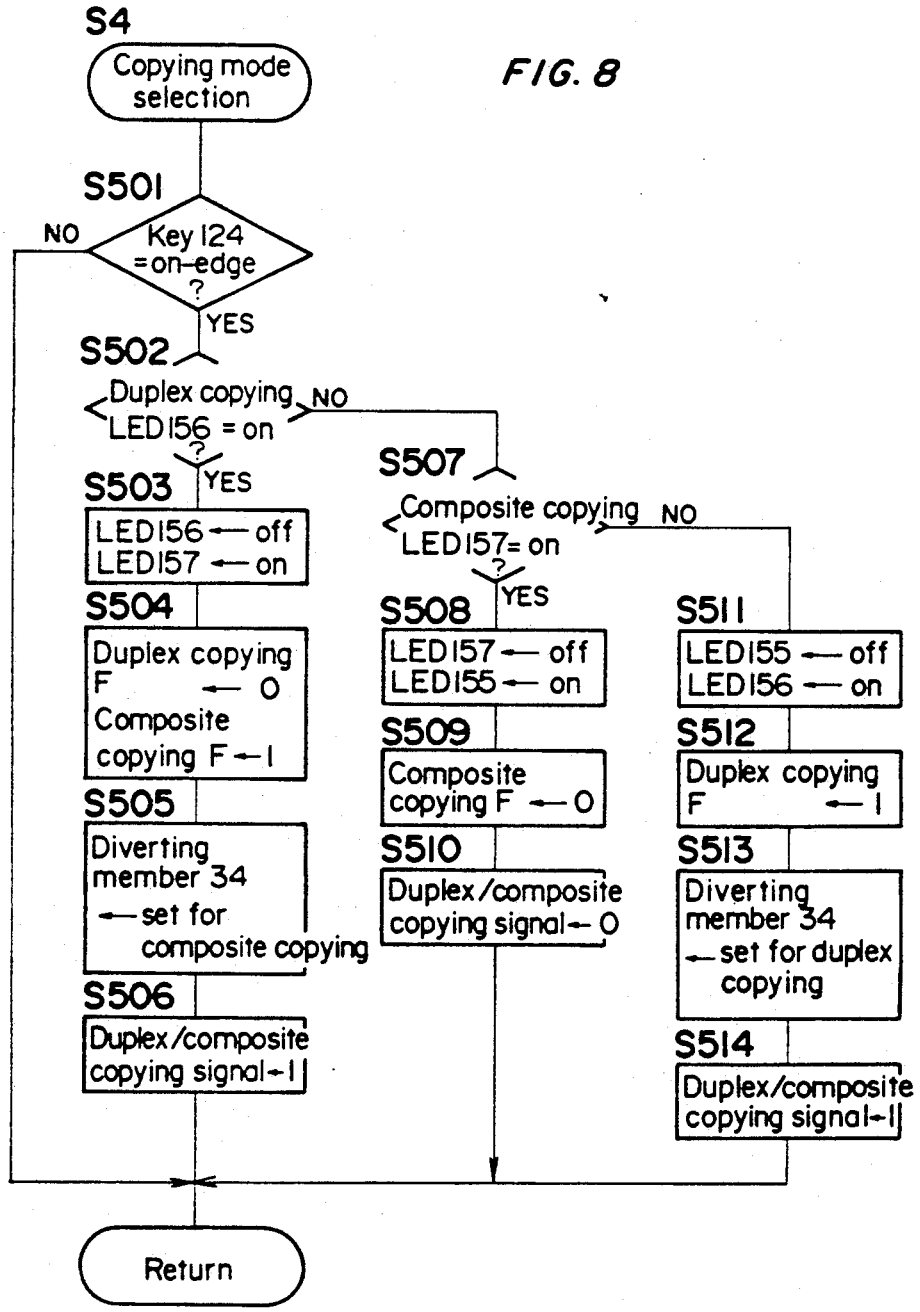
FIG. 8 is a flowchart showing a subroutine for selecting a copying mode.

FIG. 8 shows a subroutine for selecting a copying mode with the copying mode selection key 124, which is executed at step S4.

First, at step S501 the copying mode selection key 124 is checked whether on-edge or not. When it is on-edge, at step S502 the duplex copying mode LED 156 is checked whether on or not, that is, it is checked whether or not the current operation has been performed in the duplex copying mode. When the LED 156 is on, at step S503 the LED 156 is turned off, and the composite copying mode LED 157 is turned on. Subsequently, at step S504 a duplex copying flag is reset to "0", and a composite copying flag is set to "1". At step S505 the diverting member 34 is positioned as shown by the dashed line in FIG. 1 for the storage of sheets for the composite copying, and at step S506 a duplex/composite copying signal to be transmitted to the second CPU 250 is set to "1".

On the other hand, when the LED 156 is judged off at step S502, at step S507 the composite copying mode LED 157 is checked whether on or not, that is, it is checked whether or not the current operation has been performed in the composite copying mode. When the LED 157 is on, at step S508 the LED 157 is turned off, and the single side copying mode LED 155 is turned on. Subsequently, at step S509 the composite copying flag is reset to "0", and at step S510 the duplex/composite signal to be transmitted to the second CPU 510 is reset to "0".

Further, when the LED 157 is judged off at step S507, which means that the current operation has been performed in the single side copying mode, at step S511 the single side copying mode LED 155 is turned off, and the duplex copying mode LED 156 is turned on. At step S512 the duplex copying flag is set to "1". At step S513 the diverting member 34 is positioned as shown by the solid line in FIG. 1 for the storage of sheets for the duplex copying. At step S514 the duplex/composite copying signal to be transmitted to the second CPU 250 is set to "1".

Figure 9:
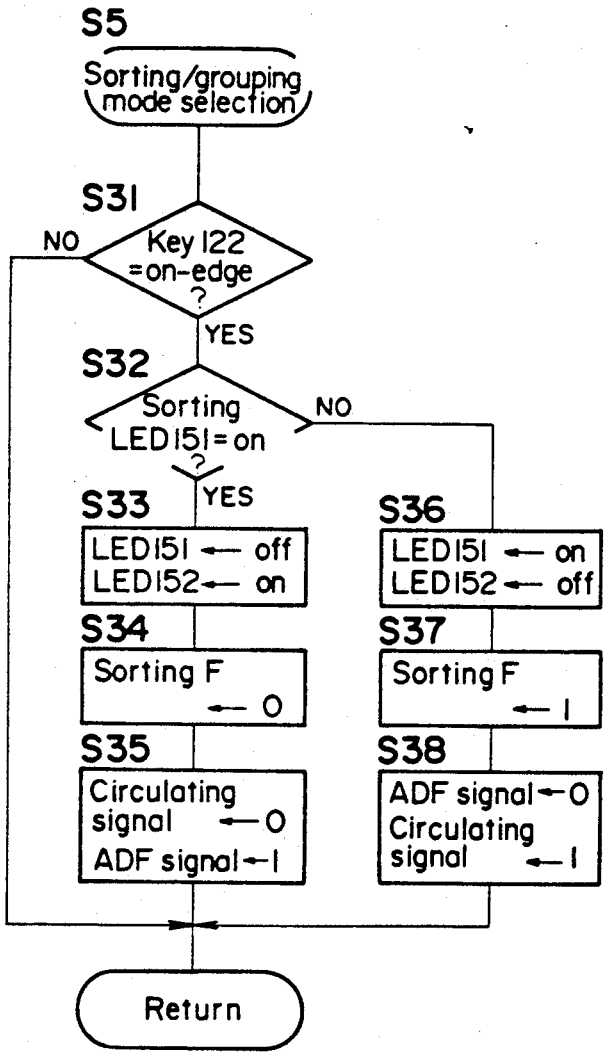
FIG. 9 is a flowchart showing a subroutine for selecting an assorting mode.

FIG. 9 shows a subroutine for selecting an assorting mode with the sorting/grouping mode selection key 121, which is executed at step S5.

Figure 10:
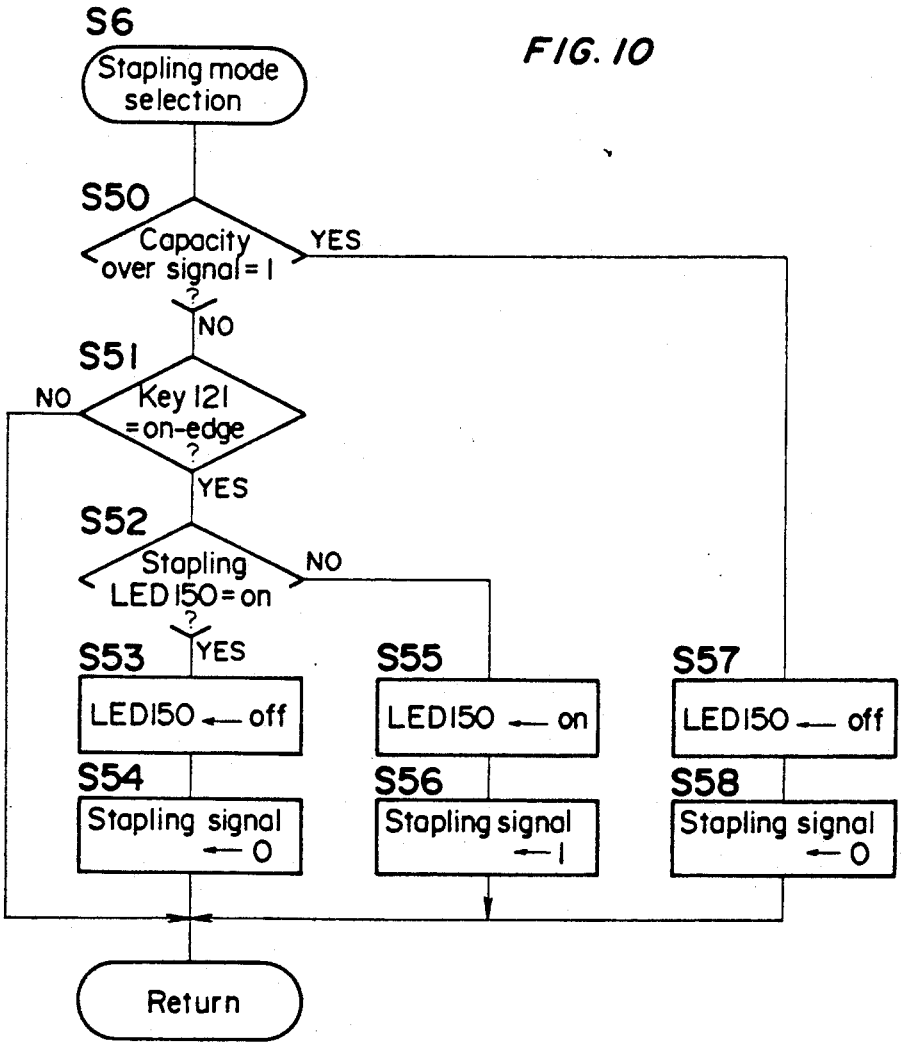
FIG. 10 is a flowchart showing a subroutine for selecting either a stapling mode or an ejection mode.

First, at step S31, the sorting/grouping selection key 122 is checked whether on-edge or not. When it is on-edge, at step S32 the sorting mode LED 151 is checked whether on or not, in other words, it is checked whether or not the current operation has been performed in the sorting mode. When the LED 151 is on, at step S33 the LEO 151 is turned off, and the grouping mode LED 152 is turned on. Subsequently, at step S34 a sorting flag is reset to "0" At step S35 a circulating signal and an ADF signal to be transmitted to the second and the third CPUs 250 and 260 are reset to "0" and set to "1" respectively. On the other hand, when the LED 151 is judged off at step S32, at step S36 the LED 151 is turned on, and the LED 152 is turned off. At step S37 the sorting flag is set to "1". At step S38 the ADF signal and the circulating signal to be transmitted to the second and the third CPUs 250 and 260 are reset to "0" and set to "1" respectively FIG. 10 shows a subroutine for selecting and cancelling the stapling mode with the stapling mode selection key 121, which is executed at step S6.

First, at step S50 a finisher capacity over signal is checked whether "1" or not. This finisher capacity over signal is set to "1", when it is judged in a subroutine for counting the number of originals, which will be described later, that the number of copies to be stored in the stapling tray 65 will be over the capacity (refer to steps S238 and S243 in FIG. 14*b*). Accordingly, when the signal is "1", at step S57 the stapling mode LED 150 is turned off, and at step S58 a stapling signal to be transmitted to the second and the third CPUs 250 and 260 is reset to "0". On the other hand, when the finisher capacity over signal is "0", at step S51 the stapling mode selection key 121 is checked whether on-edge or not. When it is on-edge, at step S52 the stapling mode LED 150 is checked whether on or not, in other words, it is checked whether or not the current operation has been performed in the stapling mode. When the LED 150 is on, at step S53 the LED 150 is turned off, and at step S54 the stapling signal to be transmitted to the second and the third CPUs 250 and 260 is reset to "0". However, when the LED 150 is judged off at step S52, at step S55 the LED 150 is turned on, and at step S56 the stapling signal to be transmitted to the second and the third CPUs 250 and 260 is set to "1".

Figure 11:
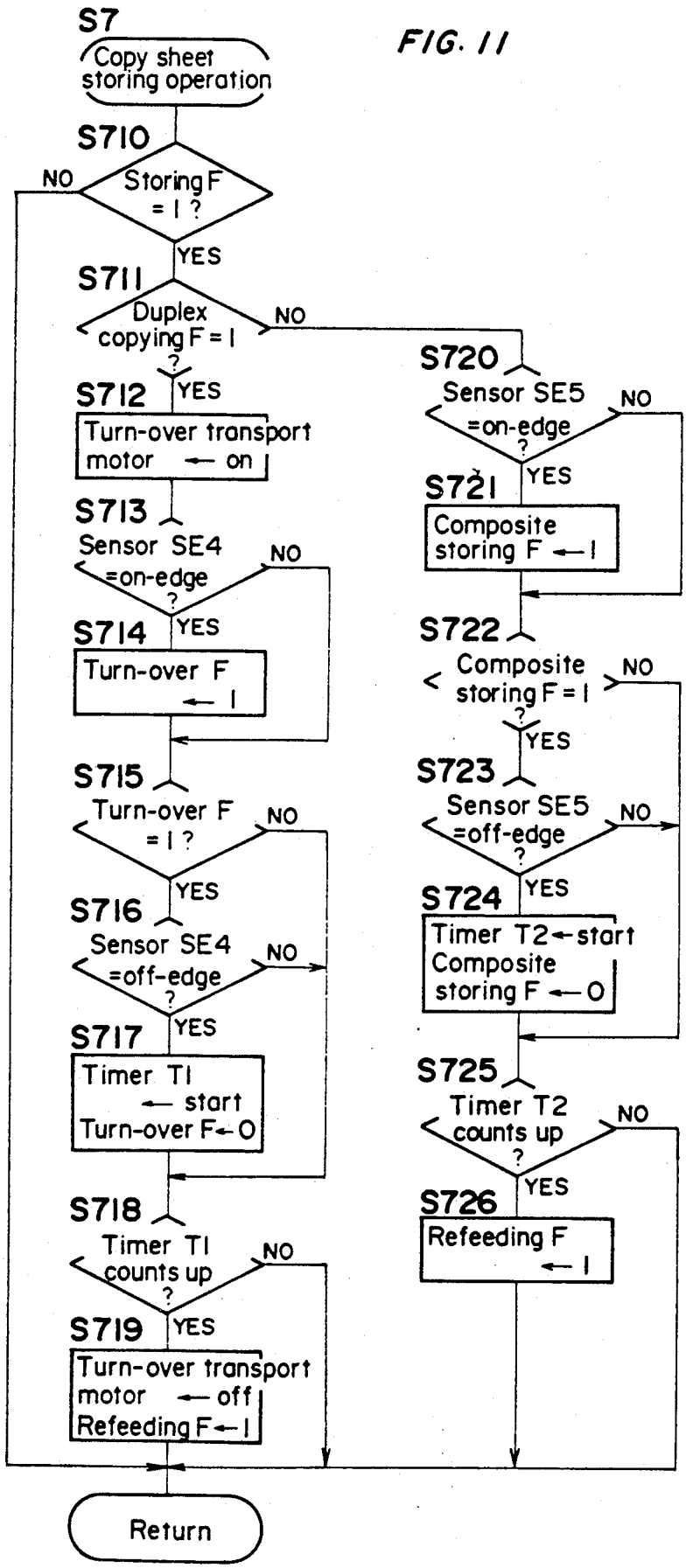
FIG. 11 is a flowchart showing a subroutine for transporting copy sheets into an intermediate tray.

FIG. 11 shows a subroutine for transporting copy sheets into the intermediate tray 31 in a case of the duplex copying or the composite copying, which is executed at step S7

First, at step S710 a storing flag is checked whether "1" or not. This storing flag is set to "1", when copy sheets which gained an image on one side need to be stored in the intermediate tray 31 (refer to step S91 in FIG. 12*a*). When the storing flag is "1", at step S711 the duplex copying flag is checked whether "1" or not. When the duplex copying flag is "1", at step S712 a turn-over transport motor is turned on to drive transport rollers of the turn-over path 35. Subsequently, when the sensor SE4 is judged at step S713 to be on-edge, which means the leading edge of a copy sheet guided into the turn-over path 35 is detected by the sensor SE4, at step S714 a turn-over flag is set to "1".

Next, at step S715 the turn-over flag is checked whether "1" or not when it is "0", the processing goes to step S718 When the turn-over flag is "1", the processing goes to step S716 where the off-edge of the sensor SE4 is confirmed, which means the trailing edge of the sheet is detected by the sensor SE4. At step S717 a timer T1 is started, and the turn-over flag is reset to "0". The time set In the tImer T1 is a time required for a sheet which has passed through the sensor SE4 to enter the intermediate tray 31. After it is confirmed at step S718 that the timer T1 counts up, at step S719 the turn-over transport motor is turned off, and a refeeding flag is set to "1".

On the other hand, when the duplex copying flag is judged "0" at step S711, which means the composite copying mode is selected, the processing goes to step S720 where the on-edge of the sensor SE5 is confirmed, which means the leading edge of a copy sheet reaches a back entrance of the intermediate tray 35. Then, at step S721 a composite storing flag is set to "1". At step S722 the composite storing flag is checked whether "1" or not. When it is "0", the processing goes to step S725. When it is "1", the processing goes to step S723 where the off-edge of the sensor SE5 is confirmed. Thereafter, at step S724 a timer T2 is started, and the composite storing flag is reset to "0". The time set in the timer T2 is a time required for a copy sheet which has passed through the sensor SE5 to enter the intermediate tray 31. Subsequently, it is confirmed at step S725 that the timer T2 counts up, and at step S726 the refeeding flag is set to "1".

Figure 12A:
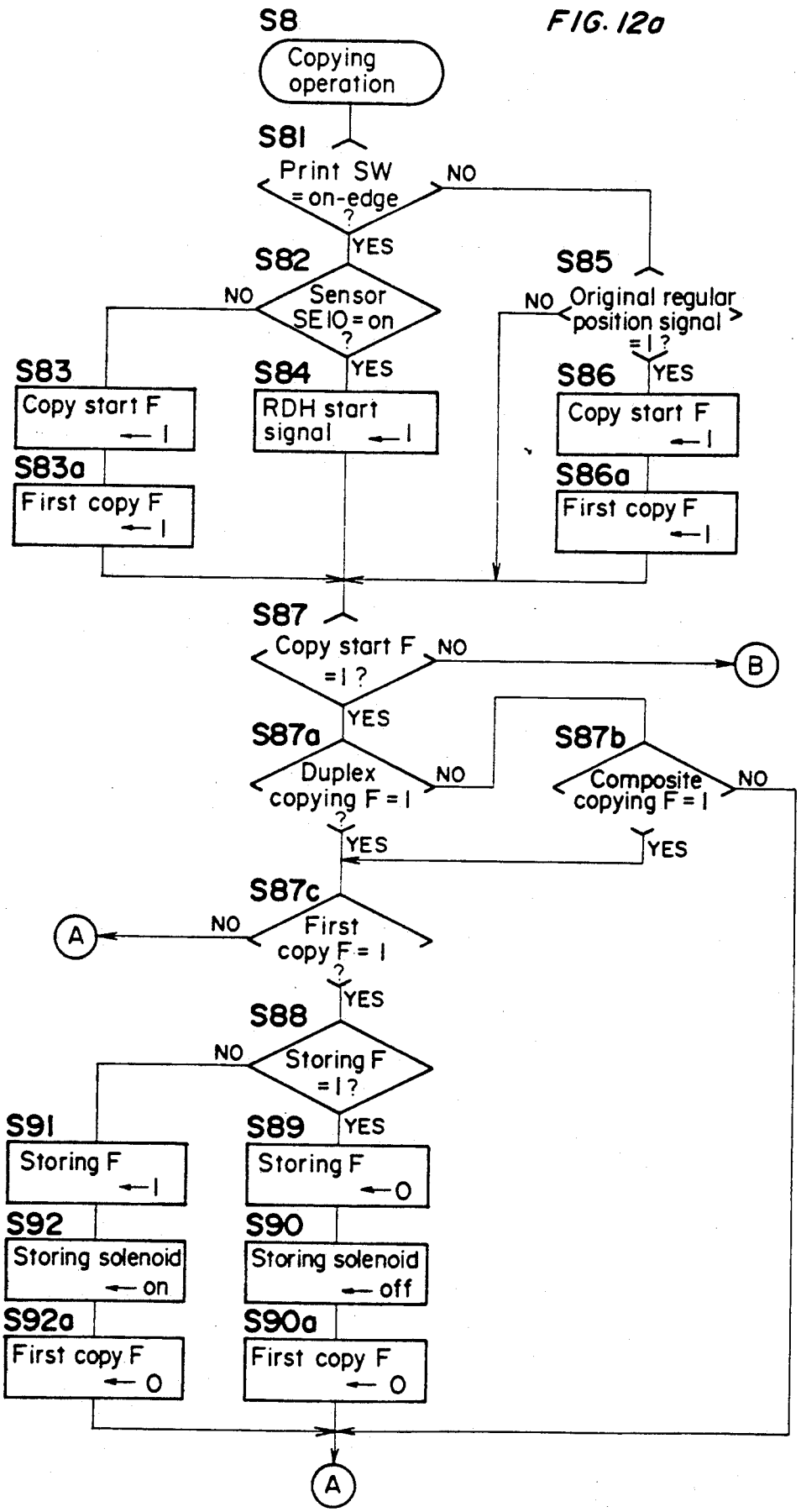
FIGS. 12*a*, 12*b* and 12*c* are flowcharts showing a subroutine for controlling a copying operation.
Figure 12B:
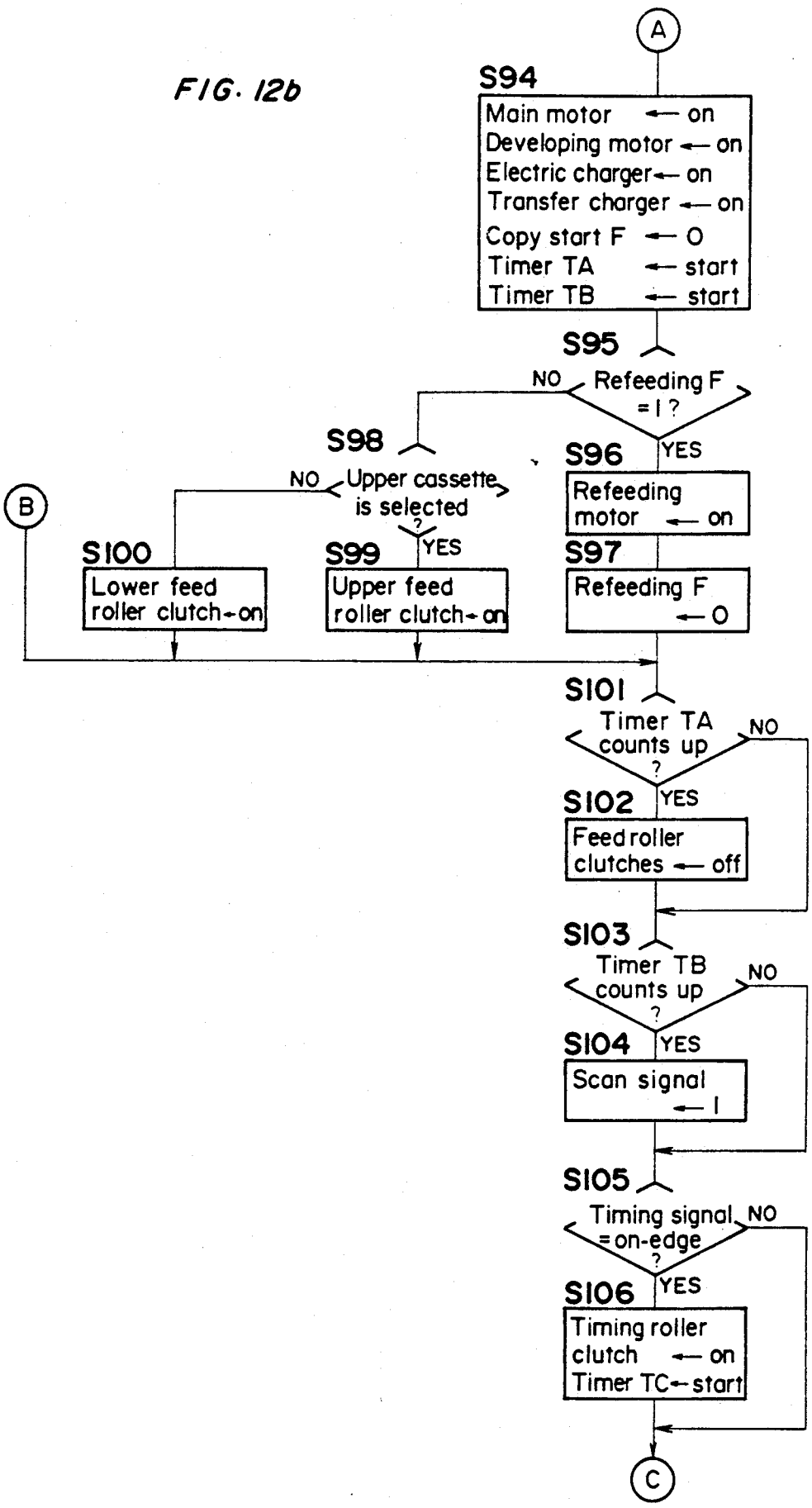
Figure 12C:
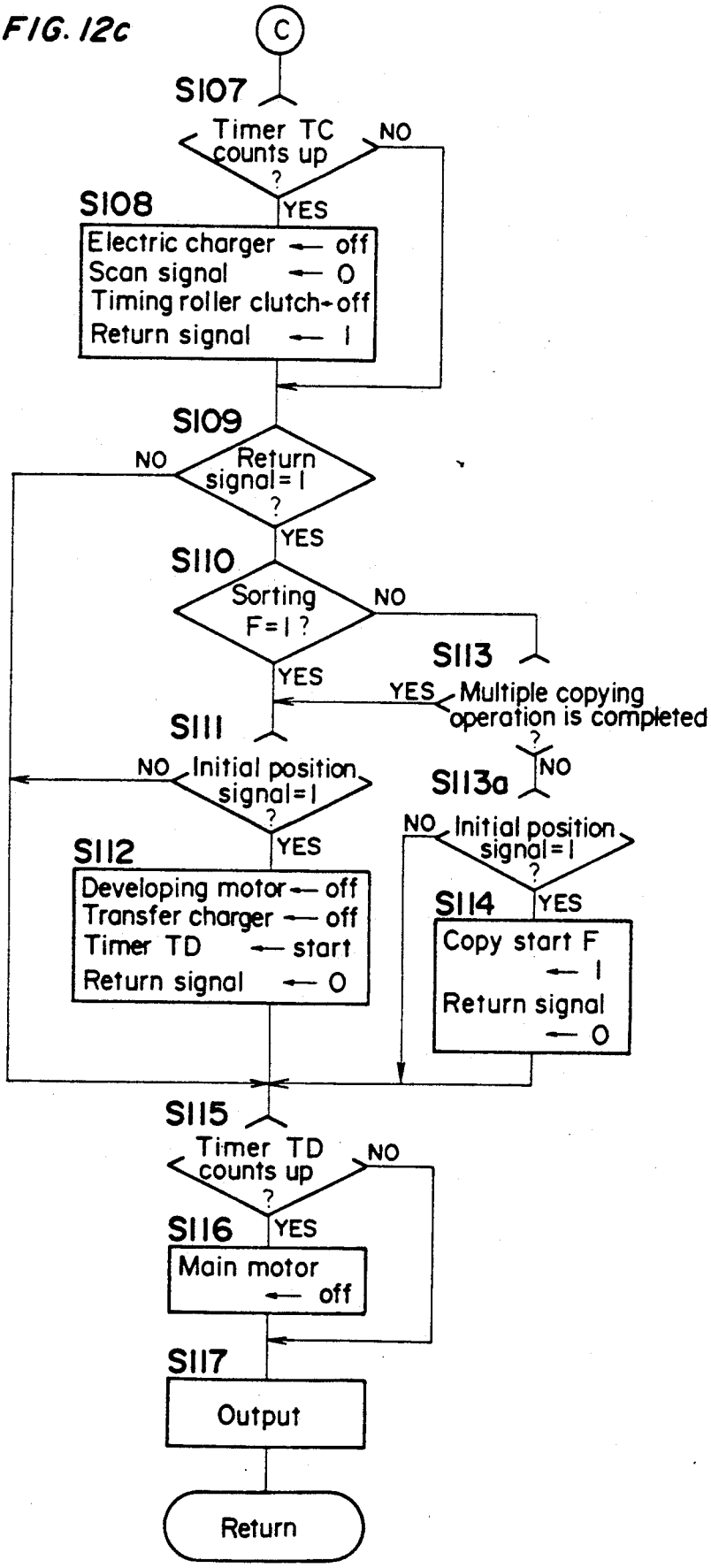

FIGS. 12*a*, 12*b* and 12*c* show a subroutine for performing a copying operation in the copying machine 1, which is executed at step S8.

First, at step S81 the print switch 101 is checked whether on-edge or not. When it is on-edge, the presence or the absence of originals on the original table 51 is judged at step S82 from the on/off state of the sensor SE10. When there is any original on the original table 51, at step S84 an RDH start signal is set to "1" in order to start a copying operation with use of the RDH 50. Thereafter, the processing goes to step S87. When there are no originals on the original table 51, it is judged that an original was placed on the original glass 19 manually. Then, at step S83 a copy start flag is set to "1", and at step S83*a* a first copy flag indicating the first copying cycle of a multiple copying operation is set to "1". Thereafter the processing goes to step S87.

On the other hand, when the print switch 101 is not on-edge ("NO" at step S81), at step S85 an original regular position signal is checked whether "1" or not. The original regular position signal is set to "1", when an original is put in the regular position on the original glass 19 by the RDH 50 (refer to steps S290 in FIG 16, S320 in FIG. 17 and S367 in FIG. 19). Accordingly, when the original regular position signal is judged "1", which means the copying operation is performed using the RDH 50, at step S86 the copy start flag is set to "1", and at step S86*a* the first copy flag is set to "1".

Next, at step S87 the copy start flag is checked whether "1" or not. When it is "0", the processing goes to step S101. When it is "1", the duplex copying flag and the composite copying flag are checked whether "1" or not at steps S87*a* and S87*b* respectively. When both of the flags are "0", the processing goes to step S94, and when either of them is "1", the processing goes to step S87*c* to check the first copy flag whether "1" or not. When the first copy flag is "0", processing goes to step S88 to check the storing flag whether "1" or not. When the storing flag is "1", which means that it is in the middle of a copy sheet storing operation under the subroutine at step S7, at step S89 the storing flag is reset to "3". Then, a storing solenoid is turned off at step S90, and the first copy flag is reset to "0" at step S90*a*. The storing solenoid functions to activate the diverting member 36, and when the solenoid is turned off, the diverting member 36 is set to the position where copy sheets are guided toward the finisher 60. However, when the storing flag is judged "0" at step S88, at step 891 the storing flag is set to "1", and at step S92*a* the first copy flag is reset to "0". Thereby, a copy sheet which obtained an image on one side is guided to the intermediate tray 31 through the path 37.

Next, at step S94 a main motor, a developing motor, the electric charger, the transfer charger, etc. are turned on to start a copying operation. Simultaneously, the copy start flag is reset to "0", and timers TA and TB are started. At step S95 the refeeding flag is checked whether "1" or not. When it is "1" (refer to steps S719 and S726 in FIG. 11), at step S96 a refeeding motor driving the refeed rollers 32, etc. is turned on, and at step S97 the refeeding flag is reset to "0". When the refeeding flag is judged "0"at step S95, it is checked at step S98 whether or not the upper feed cassette 20 is selected. When the result is "YES", at step S99 an upper feed roller clutch is turned on, and when the result is "NO", at step S100 a lower feed roller clutch is turned on. Thereby, a copy sheet is fed out of either one of the cassettes 20 and 22.

Next, it is checked at step S101 that the timer TA counts up, and thereafter the feed roller clutches are turned off at step S102. Also, it is confirmed at step S103 that the timer TB counts up, and thereafter a scan signal is set to "1" at step S104. The scan signal is for starting a scan of an original image by the optical system 10. Further, the control procedure of the optical system 10 is so well-known way that the detailed description is omitted.

The on-edge of a timing signal is confirmed at step 105, and thereafter at step S106 a timing roller clutch is turned on, and a timer TC is started. It is confirmed at step S107 that the timer TC counts up, and at step S108 the electric charger is turned off, the scan signal is reset to "0", the timing roller clutch is turned off, and a return signal is set to "1". Further, the return signal is checked at step S109 whether "1" or not. The return signal is set to "1", when the optical system 10 is to return toward the initial position after an image scan. Accordingly, when the return signal is "1", the processing goes to step S110 where the sorting flag is checked whether "1" or not. When the sorting flag is "1", which means the sorting mode is selected, the processing goes to step S111 and follows the successive steps to complete one cycle of a copying operation. When the sorting flag is "0", the processing goes to step S113 to check the completion of the multiple copying operation, that is, it is checked whether or not the image scans were repeated corresponding to the number of copies set by an operator. When it has not been completed, at step S113*a* an initial position signal is checked whether "1" or not. The initial position signal is set to "1", when the optical system 10 returns to the initial (scan starting) position. Accordingly, when the initial position signal is "1", at step S114 the copy start flag is set to "1", and the return signal is reset to "0". When the multiple copying operation in the sorting mode is completed, at step S111 the initial position signal is checked whether "1" or not. When it is "1", at step S112 the developing motor and the transfer charger are turned off, a timer TD is started, and the return signal is reset to "0". Subsequently, it is confirmed at step S115 that the timer TD counts up, the main motor is turned off at step S116, and the outcome of the operation is figured out at step S117.

Control Procedure of the RDH

Figure 13:
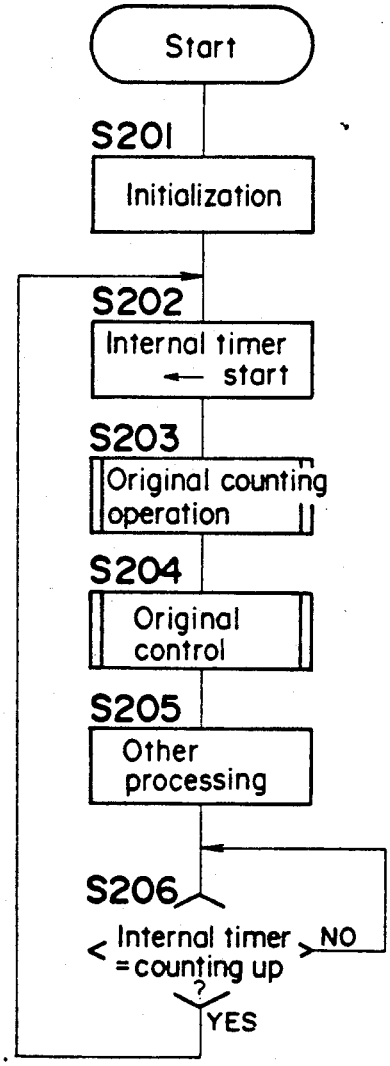
FIG. 13 is a flowchart showing a main routine of the microcomputer which controls the automatic document feeder.

FIG. 13 shows a main routine of the second CPU 250 controlling the RDH 50.

When the CPU 250 is reset to start a program, first, at step S201 a RAM is cleared, every register is initialized, and every device is set to the initial mode, Next, an internal timer is started at step S202. The internal timer determines a time required for one cycle of the main routine, and the value is predetermined at step S201.

Then, at step S203 and S204 subroutines are called in order, and the other processing is executed at step S205. The subroutines to be executed at steps S203 and S204 will be explained in detail later. Subsequently, the processing waits for the internal timer's counting up at step S206, and thereafter returns to step S202. The time required for one cycle of the main routine is used for determining a time to be set in a timer for each subroutine.

Figure 14A:
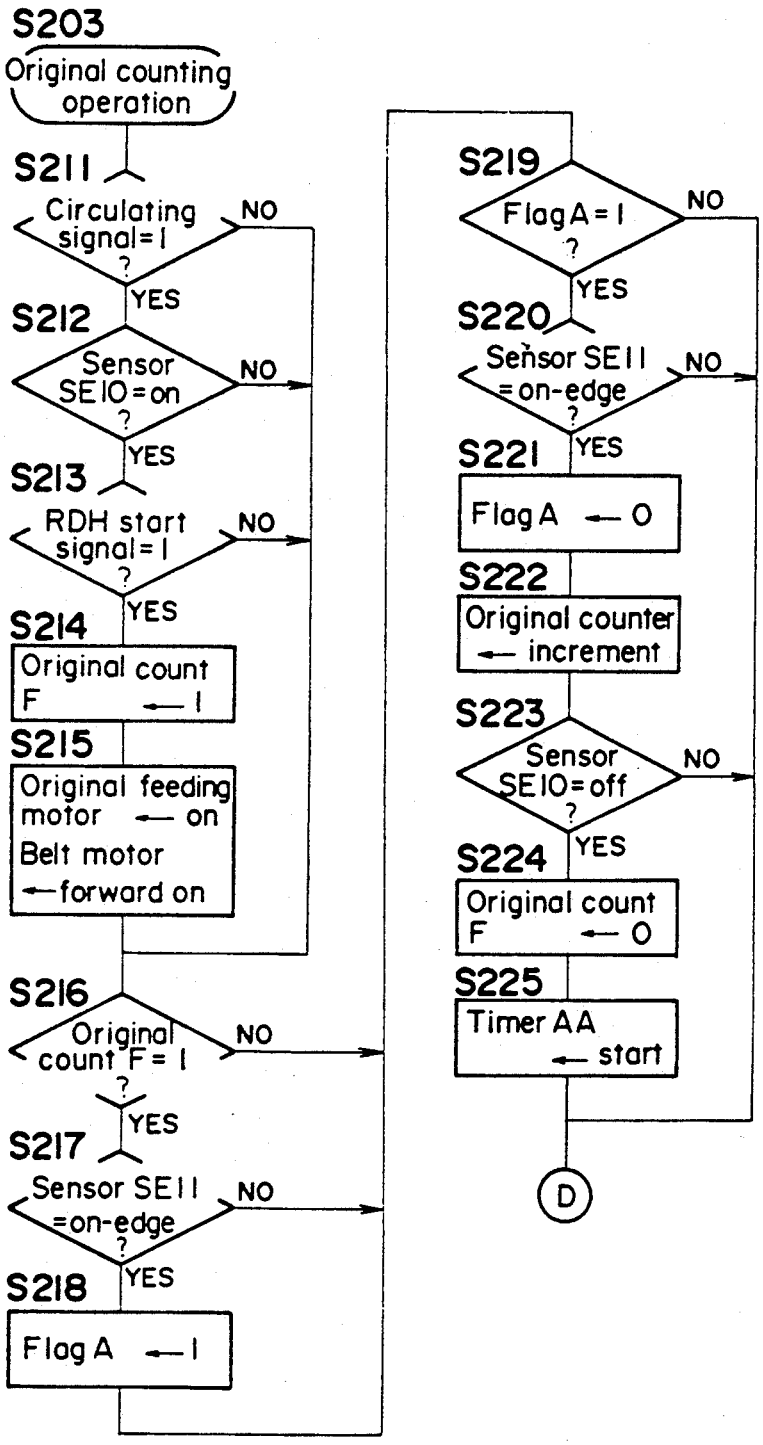
FIGS. 14*a*, 14*b* and 14*c* are flowcharts showing a subroutine for counting the number of originals.
Figure 14B:
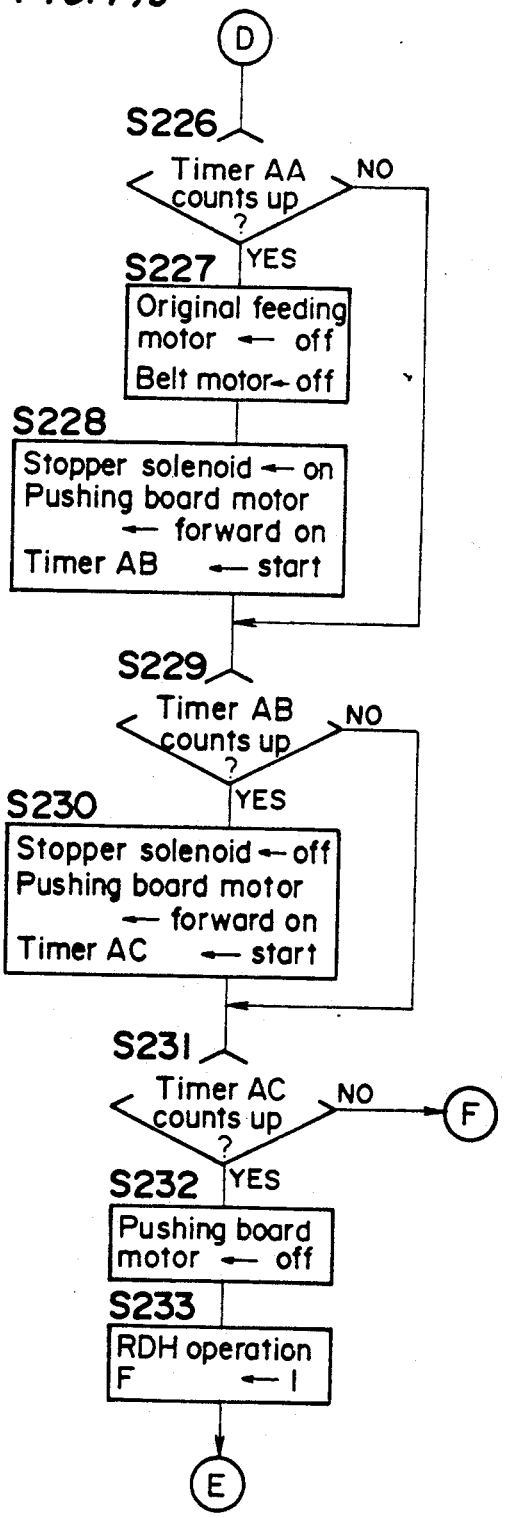
Figure 14C:
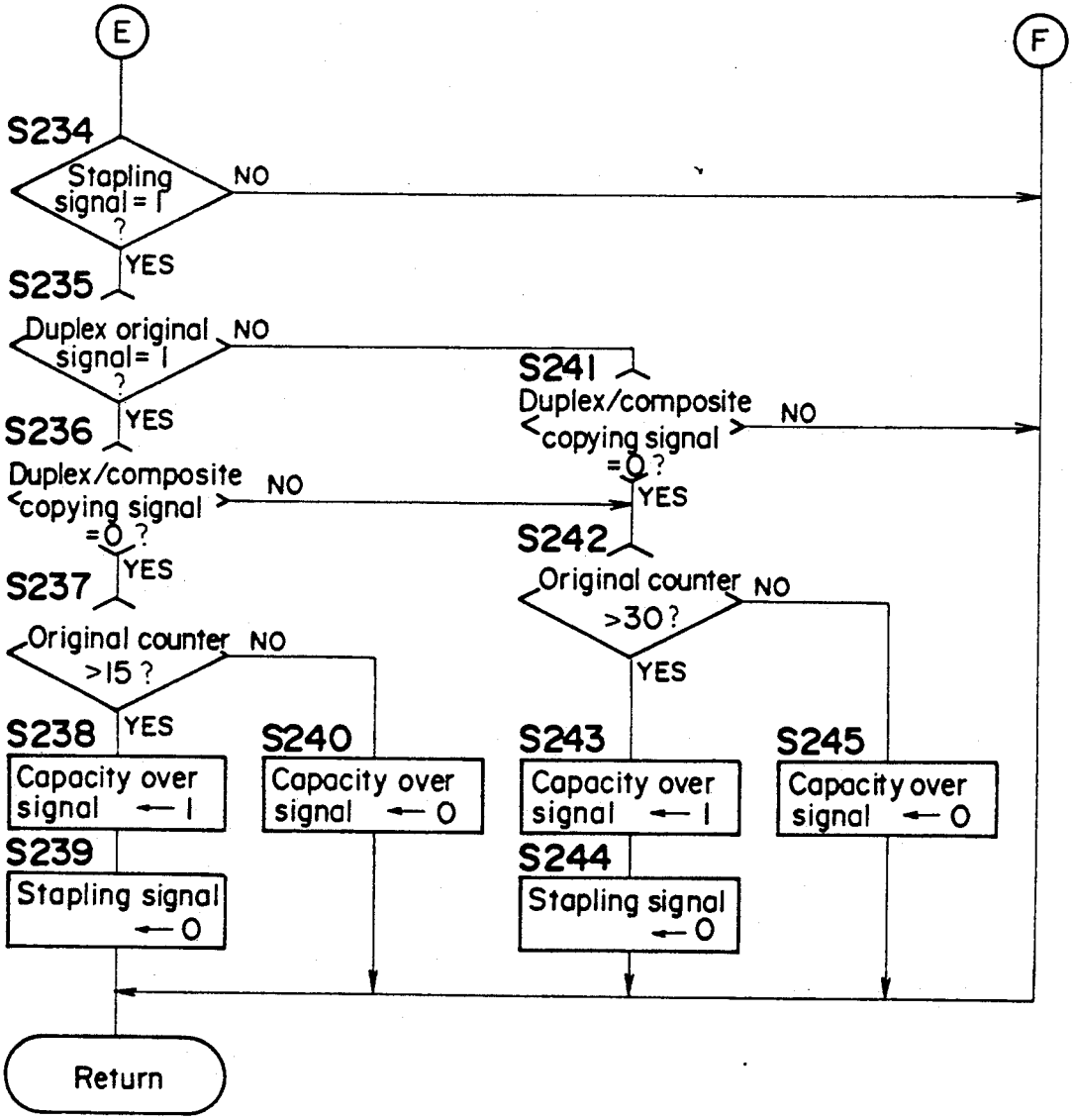

FIGS. 14*a*, 14*b* and 14*c* show a subroutine for counting the number of originals, which is executed at step S203.

First, at step S211 the circulating signal (refer to steps S35 and S38 in FIG. 9) is checked whether "1" or not. When it is "0", the processing goes to step S216. When it is "1", which means the sorting mode is selected, the processing goes to step S212 where the presence or the absence of originals on the original table 51 is judged from the on/off state of the sensor SE10. When there is any original on the original table 51, it is confirmed at step S213 that an RDH start signal is "1", and at step S214 an original count flag is set to "1". At step S215 the original feeding motor is turned on and the conveyer belt motor is rotated forward. Thereby, the feed belt 52 and the feed rollers 53 are driven to rotate, and the conveyer belt 55 is rotated in the direction of the arrow c.

Next, at step S216 the original count flag is checked whether "1" or not. When it is "1", the original detection sensor SE11 is checked whether on-edge or not at step S217. When it is on-edge, a flag A is set to "1" at step S218. After it is confirmed at step S219 that the flag A is "1" and at step S220 the off-edge of the SE11, the flag A is reset to "0" at step 221, and the original counter earns an increment at step S222. Thus, every time the trailing edge of each original passes through the sensor SE11, the original counter earns an increment. When the sensor SE10 is judged off at step S223, which means there are no more originals on the original table 51, the original count flag is reset to "0" at step S224, and a timer AA is started at step S225. The time set in the timer AA is a time required for the last original fed out of the original table 51 to return to the original table 51. Accordingly, after confirming the completion of the timer AA at step S226, the original feeding motor and the conveyer belt motor are turned off at step S227. Simultaneously, at step S228 the solenoid of the stopper 48 is turned on, a motor of the pushing board 49 is rotated forward, and a timer AB is started. Thereby, the stopper 48 retreats from the original leading edge regulating position, and the pushing board 49 is moved toward the left in FIG. 1 to push the originals which were circulated once and returned to the original table 51 toward the left. The time set in the timer AB is a time required for the originals to travel to the feed position. Accordingly, after it is confirmed at step S229 that the timer AB counts up, at step S230 the solenoid of the stopper 48 is turned off to return the stopper 48 to the regulating position, the motor of the pushing board 49 is rotated backward, and a timer AC is started. The processing wait for the completion of the timer AC at step 231, and at step S232 the motor of pushing board 49 is turned off, and an RDH operation flag is set to "1".

Next, at step S234 the stapling signal is checked whether "1" or not. When it is "1" (refer to step S56 in FIG. 10), a duplex original signal is checked whether "1" or not at step S235. At either step S236 or step S241, the duplex/composite copying signal is checked whether "0" or not. When the result at step S236 is YES, which means the duplex original feeding mode and the single side copying mode are selected, the processing goes to step S237 where it is checked whether or not the value of the original counter is more than "15". When the result is YES, more than 30 copy sheets will be transported into the stapling tray 65, which is over the capacity. Accordingly, at step S238 the finisher capacity over signal to be transmitted to the first CPU 201 is set to "1", and at step S239 the stapling signal is reset to "0". When the result at step S237 is NO, which means the number of copy sheets to be stored in the stapling tray 65 will be within the capacity, at step S240 the finisher capacity over flag to be transmitted to the first CPU 201 is kept "0".

When the result at step S241 is YES, which means the single side original mode and the single side copying mode are selected, the processing follows steps S242 through S245 in the same way as described above. However, when the result at step S241 is NO, which means the single side original feeding mode and either one of the duplex copying mode or the composite copying mode are selected, the number of copy sheets to be stored in the stapling tray 65 will never be over 25 because the capacity of the RDH 50 is 50 originals. Therefore, in this case, the stapling operation never has to be canceled, so that this subroutine is immediately completed.

However, if the capacity of the RDH 50 is more than 60, the following processing is necessary. When the single side original feeding mode and either one of the duplex copying mode or the composite copying mode are selected (NO at step S241), it is checked whether or not the value of the original counter is more than "60". When the result is YES, the processing similar to that of steps S243 and S244 is executed. When the result is NO, the processing similar to that of step S245 is executed.

Figure 15A:
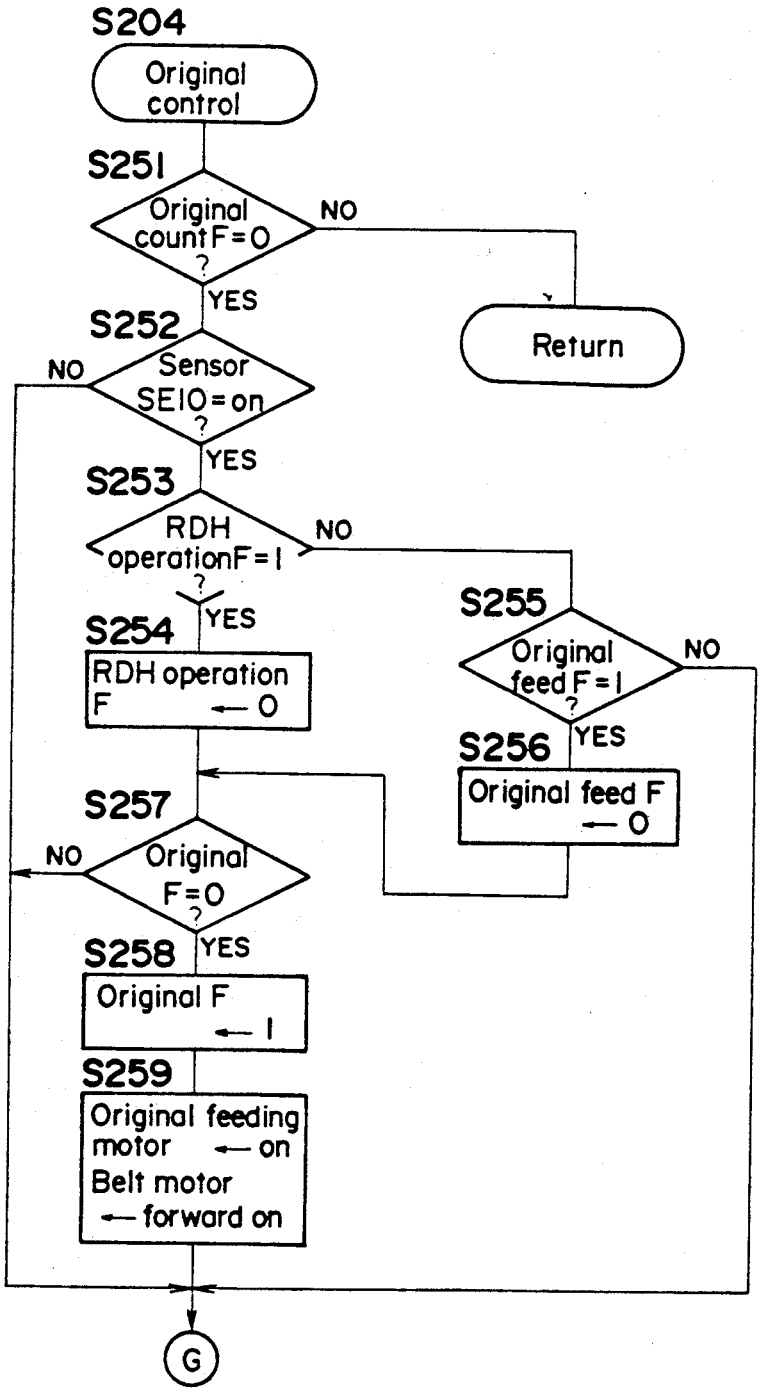
FIGS. 15*a* and 15*b* are flowcharts showing a subroutine for feeding, stopping and discharging originals.
Figure 15B:
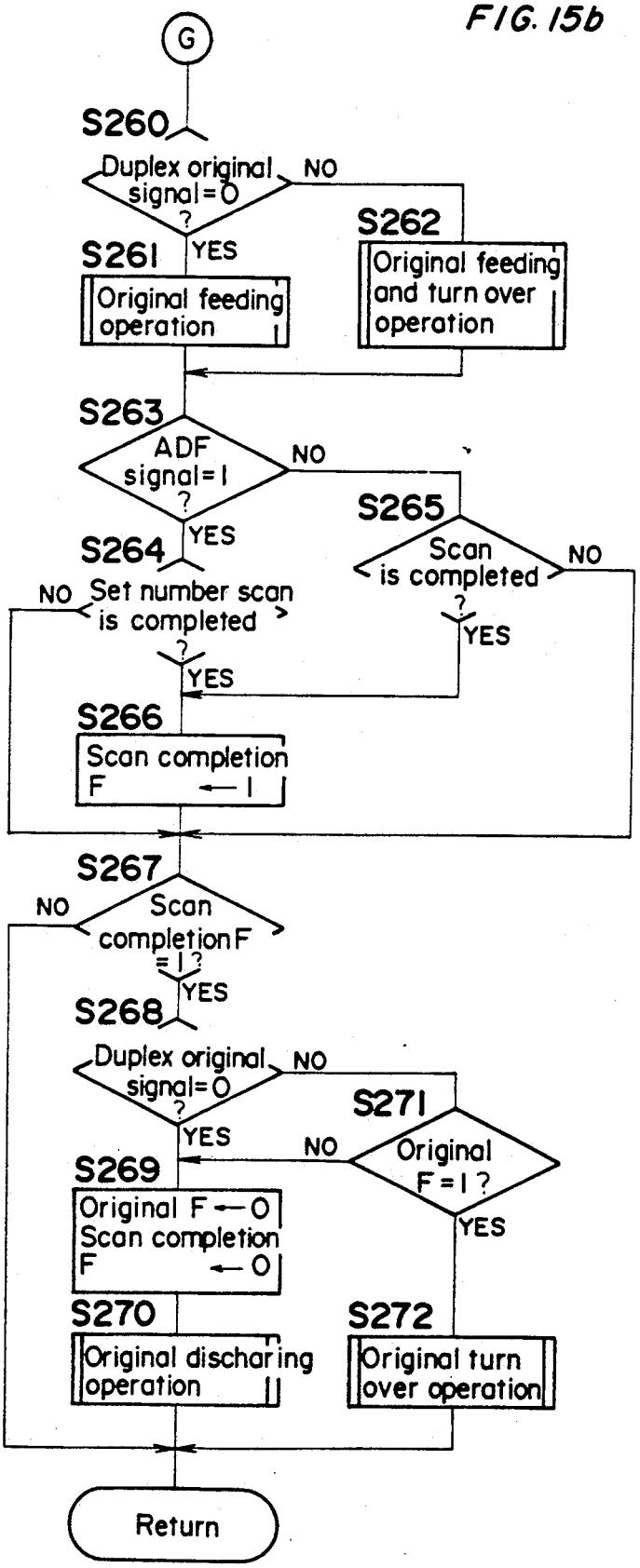

FIGS. 15*a* and 15*b* show a subroutine for feeding, stopping and ejecting originals, which is executed at step S204.

First, at step S251 the original count flag is checked whether "0" or not. When it is "1", the original counting operation is going on under the subroutine as shown in FIGS. 14*a*, 14*b* and 14*c*, so that the subroutine is immediately completed. Only when the original count flag is "0", the following processing is executed.

At step S252 the presence or the absence of originals on the original table 51 is judged from the on/off state of the sensor SE10. When there are no originals on the original table 51 (the sensor SE10 is off), the processing goes to step S260. When there is any original (the sensor SE10 is on), the processing goes to step S253 to check the RDH operation flag whether "1" or not. When the flag is "1" (refer to step S233), the flag is reset to "0" at step S254, and thereafter the processing goes to step S257. When the RDH operation flag is judged "0" at step S253, an original feed flag is checked whether "1" or not at step S255. This original feed flag is set to "1", when the next original is ready for the feeding as described later in connection with steps S270 and S332. When the original feed flag is "1", at step S256 the flag is reset to "0", and thereafter the processing goes to step S257. When the original feed flag is judged "0" at step S255, the processing goes to step S260.

At step S257 an original flag is checked whether "0" or not. When the original flag is "1", it orders an original feeding operation. Accordingly, when the flag is "0", at step S258 the flag is set to "1", and at step S259 the original feeding motor is turned on, and the conveyer belt motor is rotated forward. When the original flag is "1" at step S257, the processing goes to step S260.

At step S260 the duplex original signal is checked whether "0" or not. When the signal is "0", which means the single side original feeding mode is selected, at step S261 a subroutine for feeding an original is executed. When it is "1", which means the duplex original feeding mode is selected, at step S262 a subroutine for feeding and turning over an original is executed subsequently, the ADF signal is checked whether "1" or not at step S263. When the ADF signal is "1", which means the grouping mode is selected (refer to step S35 in FIG. 9), it is checked at step S264 whether or not the optical system 10 has completed scanning the original to make the set number of copies. When the scan is completed, a scan completion flag is set to "1" at step S266. However, when it is judged that the ADF signal is "0" at step S263, which means that the sorting mode is selected (refer to step S38 in FIG. 9), it is checked at step S265 whether or not the optical system 10 has completed scanning the original once. When the scan is completed, at step S266 the scan completion flag is set to "1".

Next, at step S267 the scan completion flag is checked whether "1" or not. When it is "1", the duplex original signal is checked whether "0" or not at step S268, and the original flag is checked whether "1" or not at step S271. When either the duplex original signal or the original flag is "0", the original flag and the scan completion flag are reset to "0" at step S269. Then, a subroutine for discharging an original is executed at step S270. However, when both the duplex original flag and the original flag are "1", a subroutine for turning over an original is executed at step S272 to turn over the original which was turned over at step S262 again.

Figure 16:
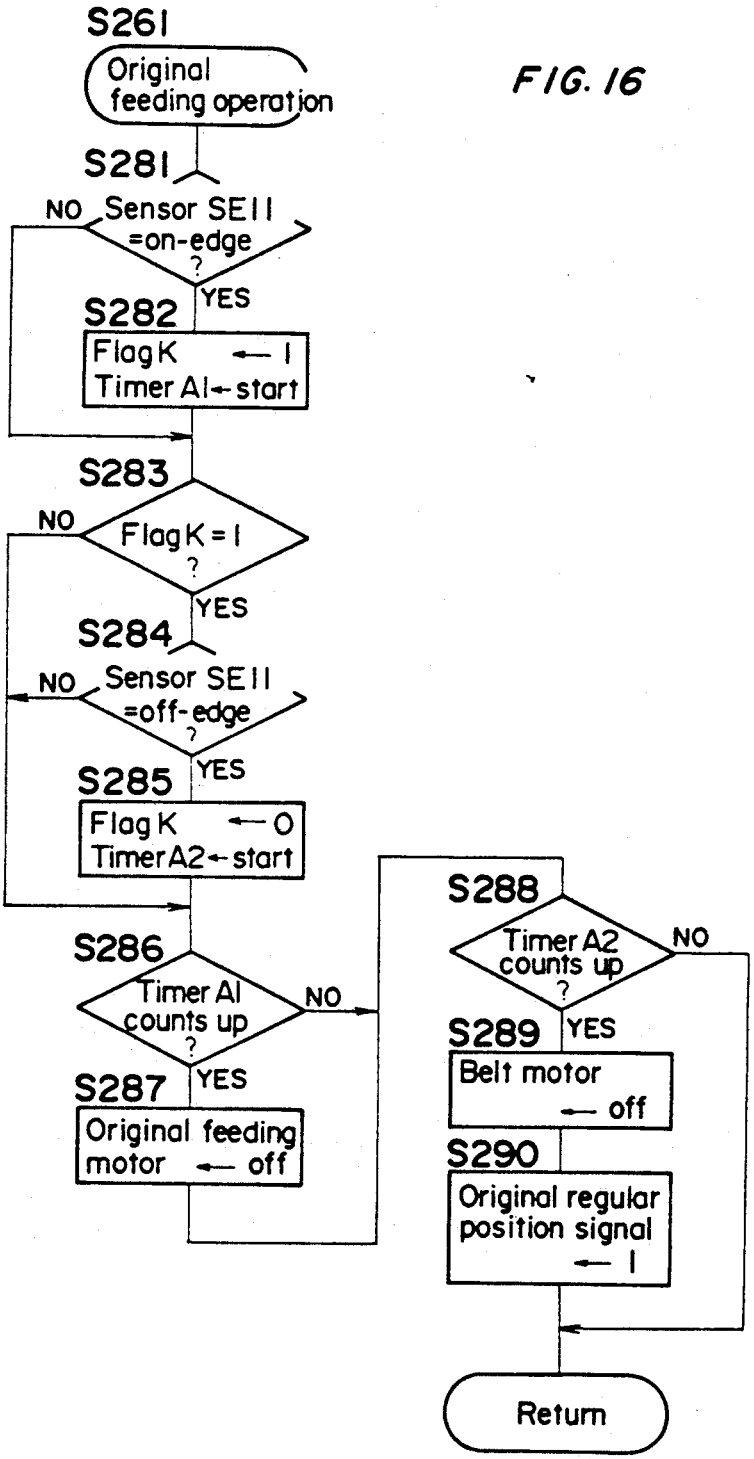
FIG. 16 is a flowchart showing a subroutine for feeding an original in the single side original feeding mode.

FIG. 16 shows the subroutine for feeding an original in the single side original feeding mode, which is executed at step S261 in FIG. 15*b*.

When an original is fed, and the sensor SE11 is judged on-edge at step S281, that is, when the leading edge of the original is detected by the sensor SE11, at step S282 a flag K is set to "1", and a timer A1 is started. The timer A1 is used for stopping the original feeding motor in order to prevent the feed rollers from feeding the next original. The time set in the timer A1 is a time required for the fed original to reach the position where the original is provided with a transporting force by the conveyer belt 55.

Next, the flag K is confirmed "1" at step S283, and when the original detection sensor SE11 is judged off-edge at step S284, that is, the trailing edge of the original is detected by the sensor SE11, at step S285 the flag K is reset to "0", and a timer A2 is started. The time set in the timer A2 is a time required for the leading edge of the original to reach the position where the image starts to be exposed to light. Subsequently, it is confirmed at step S286 that the timer A1 counts up, and the original feeding motor is turned off at step S287. After it is confirmed at step S288 that the timer A2 counts up, at step S289 the conveyer belt motor is turned off. Thereby, the original is placed to the regular position on the original glass 19, and the original regular position signal is set to "1" to complete this subroutine.

Figure 17:
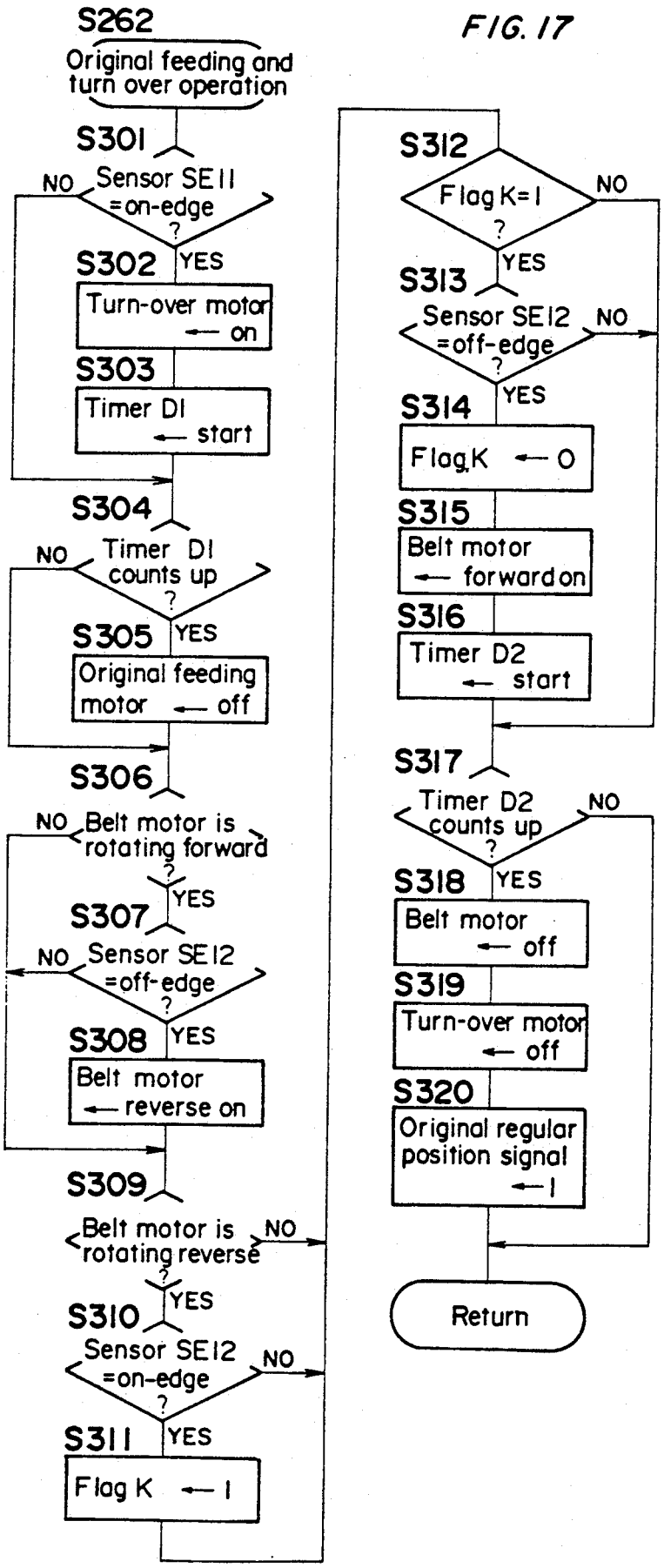
FIG. 17 is a flowchart showing a subroutine for feeding and turning over an original in the duplex original feeding mode.

FIG. 17 shows the subroutine for feeding and turning over an original in the duplex original feeding mode, which is executed at step S262 in FIG. 15*b*.

When an original is fed, and the original detection sensor SE11 is judged on-edge at step S301, the turn-over motor is turned on at step 8302 to drive the turn-over section 58, and then a timer D1 is started at step 8303. This timer D1 is similar to the timer A1 used at steps S282 through S286. When it is confirmed at step S304 that the timer D1 counts up, the original feeding motor is turned off at step S305.

At step S306 the conveyer belt motor is checked whether rotating forward or not. When it is rotating forward, at step S307 the original detection sensor 8E12 disposed at the entrance of the original glass 19 is checked whether off-edge or not. When it is off-edge, that is, when the trailing edge of the original has passed the detecting point of the sensor SE12, the rotation of the conveyer belt motor is reversed. Subsequently, at step S309 the conveyer belt motor is judged rotating reverse, and at step S310 the sensor SE12 is checked whether on-edge or not. When the sensor SE12 is on-edge, which means that the original which was fed onto the original glass 19 is turned over and detected by the sensor SE12, at step S311 the flag K is set to "1". When the flag K is judged "1" at step S312, at step S313 the sensor SE12 is checked whether off-edge or not. When it is off-edge, which means that the trailing edge of the turned over original is detected by the sensor SE12, the flag K is reset to "0" at step S314. Then, at step S315 the conveyer belt motor is rotated forward, and at step S316 a timer D2 is started. The time set in the timer D2 is a time required for the leading edge of the turned over original to reach the image exposure starting position After it is confirmed at step S317 that the timer D2 counts up, the conveyer belt motor is turned off at step S318, and the turn-over motor is turned off at step S319. Then, the original regular position signal is set to "1" at step S320 to complete this subroutine.

Figure 18:
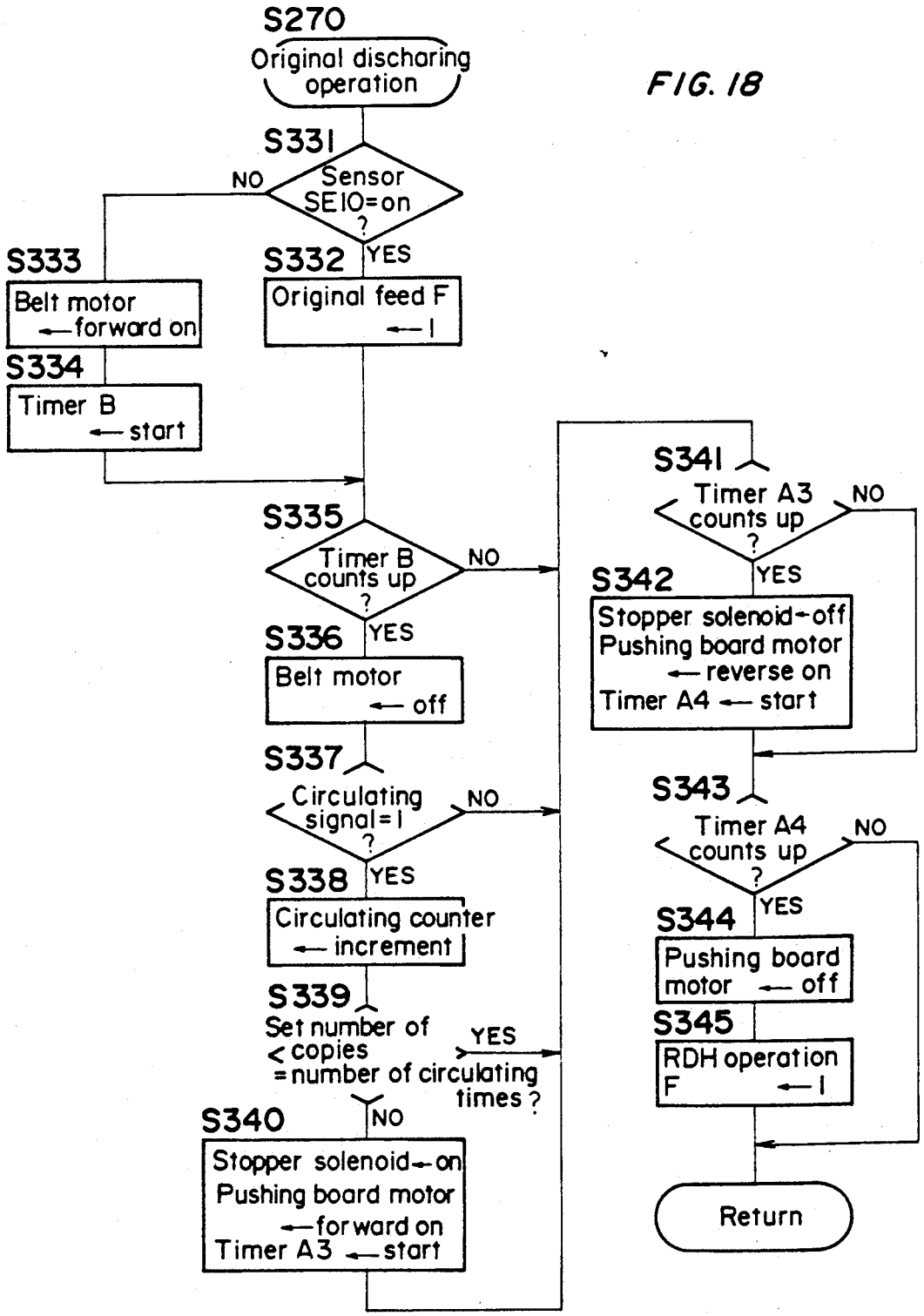
FIG. 18 is a flowchart showing a subroutine for discharging an original.

FIG. 18 shows the subroutine for discharging an original from the original glass 19, which is executed at step S270 in FIG. 15*b*.

First, at step S331 the presence or the absence of originals on the original table 51 is judged from the on/off state of the sensor SE10. When there is any original, the original feed flag is set to "1" at step S332. Thereby, while the next original is fed out of the original table 51, the original which was placed on the original glass 19 by the previous forward rotation of the conveyer belt 55 is fed back onto the original table 51.

On the other hand, when it is judged at step S331 there are no more originals on the original table 51, that is, when all the originals have been fed out, the conveyer belt motor is rotated forward at step S333, and a timer B is started at step 8334. The timer B counts a time required for an original of the longest size to be discharged from the original glass 19 onto the original table 51. Accordingly, when it is confirmed at step S335 that the timer B counts up, the conveyer belt motor is turned off at step S336.

Next, at step S337 the circulating signal is checked whether "1" or not. When it is "1", that is, when the sorting mode is selected (refer to step S38 in FIG. 9), at step S338 a circulating counter earns an increment. The number of copies to be made, which was set by an operator, is compared with the value of the circulating counter at step S339. When those values are not the same, that is, when the number of circulating times of originals has not reached the set number, at step S340 the stopper solenoid is turned on, the pushing board motor is rotated forward, and a timer A3 is started. The processing to be executed here is the same as that of step S228 (refer to FIG. 14*b*).

When it is confirmed at step S341 that the timer A3 counts up, at step S342 the stopper solenoid is turned off, the pushing board motor is reversed, and a timer A4 is started. The processing is executed here the same as step S230 (refer to FIG. 14*b*). Subsequently, when it is confirmed at step S343 that the timer A4 counts up, the pushing board motor is turned off at step S344, and the RDH operation flag is set to "1" at step S345 to complete this subroutine.

Figure 19:
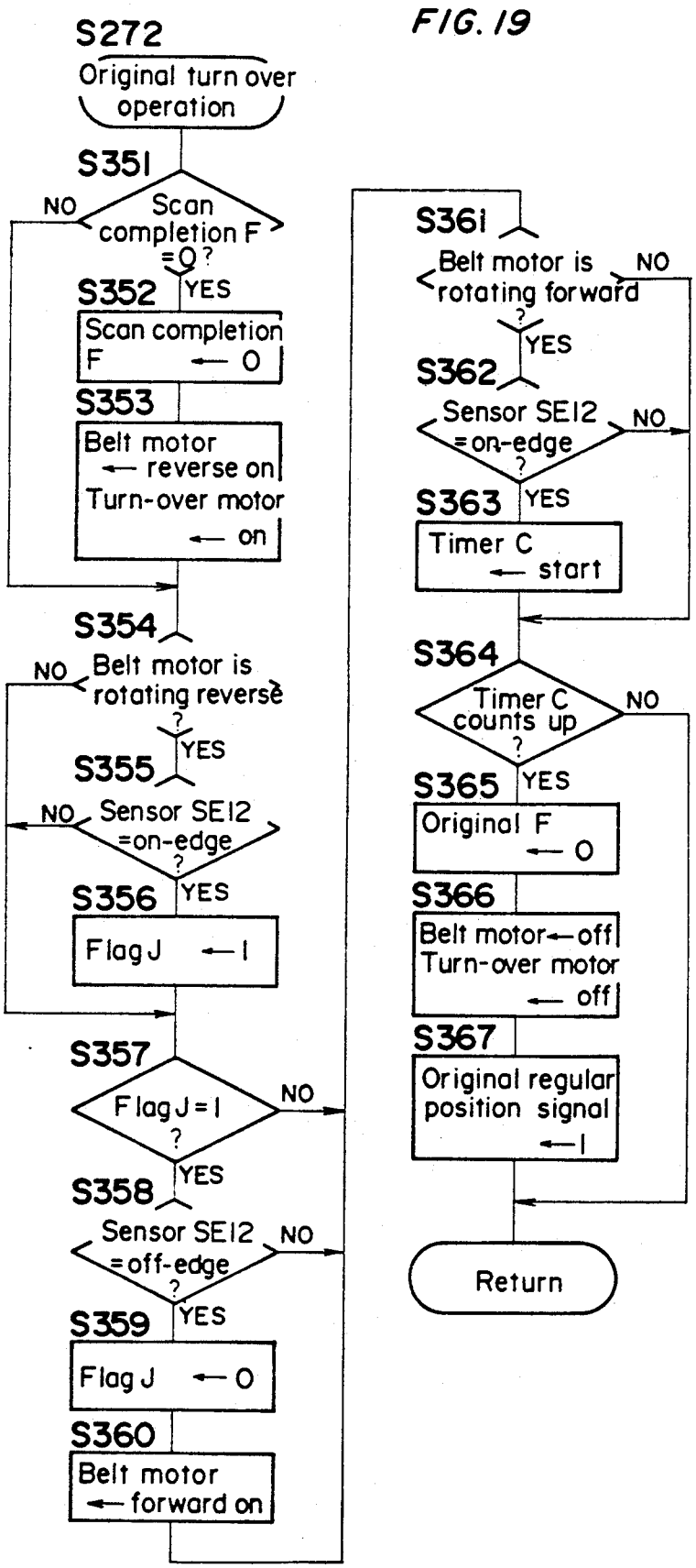
FIG. 19 is a flowchart showing a subroutine for turning over an original in the duplex original feeding mode.

FIG. 19 shows a subroutine for turning over an original in the duplex original feeding mode, which executed at step S272 in FIG. 15*b*. This subroutine is for turning over an original which was turned over at step S262 again to return the original.

First, when the scan completion flag is judged "1" at step S351, the flag is reset to "0" at step S352. Then, at step S353 the conveyer belt motor is rotated reverse and the turn-over motor is turned on. Thereby, the original on the original glass 19 is turned over. Subsequently, when the conveyer belt motor is judged rotating reverse at step S354, and the original detection sensor SE12 is judged on-edge at step S355, a flag J is set to "1" at step S356. Then, when the flag J is judged "1" at step S357, and at step S358 the off-edge of the sensor SE12 is confirmed, at step S359 the flag J is reset to "0", and at step S360 the conveyer belt motor is switched to rotate forward.

Next, when the conveyer belt motor is judged rotating forward at step S361, and the original detection sensor SE12 is judged on-edge at step S362, a timer C is started at step S363. This timer C is the same as the timer D used at steps S316 and S317, and the time set therein is a time required for the leading edge of an original to reach the image exposure starting position. Accordingly, when it is confirmed at step S364 the timer C completes counting, the original flag is reset to "0" at step 8365, and at step S366 the conveyer belt motor and the turn-over motor are turned off. Then, at step S367 the original regular position signal is set to "1" to complete this subroutine.

Control Procedure of the Finisher

Figure 20:
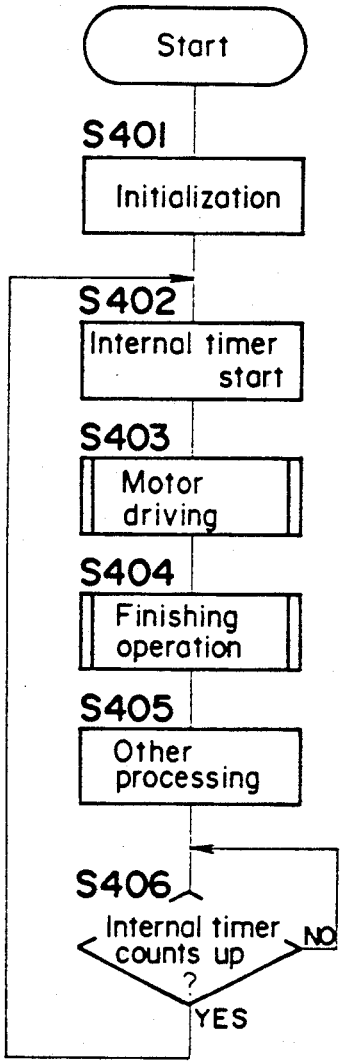
FIG. 20 is a flowchart showing a main routine of the microcomputer which controls the finisher.

FIG. 20 shows a main routine of the third CPU 260 controlling the finisher 60.

When the CPU 260 is reset to start a program, first at step S401 a RAM is cleared, every register is initialized, and every device is set to the initial mode. At step S402 an internal timer is started. The internal timer determines a time required for one cycle of the main routine, and the value is predetermined at step S401.

Next, subroutines are called at steps S403 and S404 in order, and the other processing is executed at step S405. The subroutines to be executed at steps S403 and S404 will be explained later in detail. Subsequently, it is confirmed at step S406 that the internal timer completes counting, and the processing returns to step S402. The time required for one cycle of the main routine is used for determining a time to be set in a timer for each subroutine.

Figure 21:
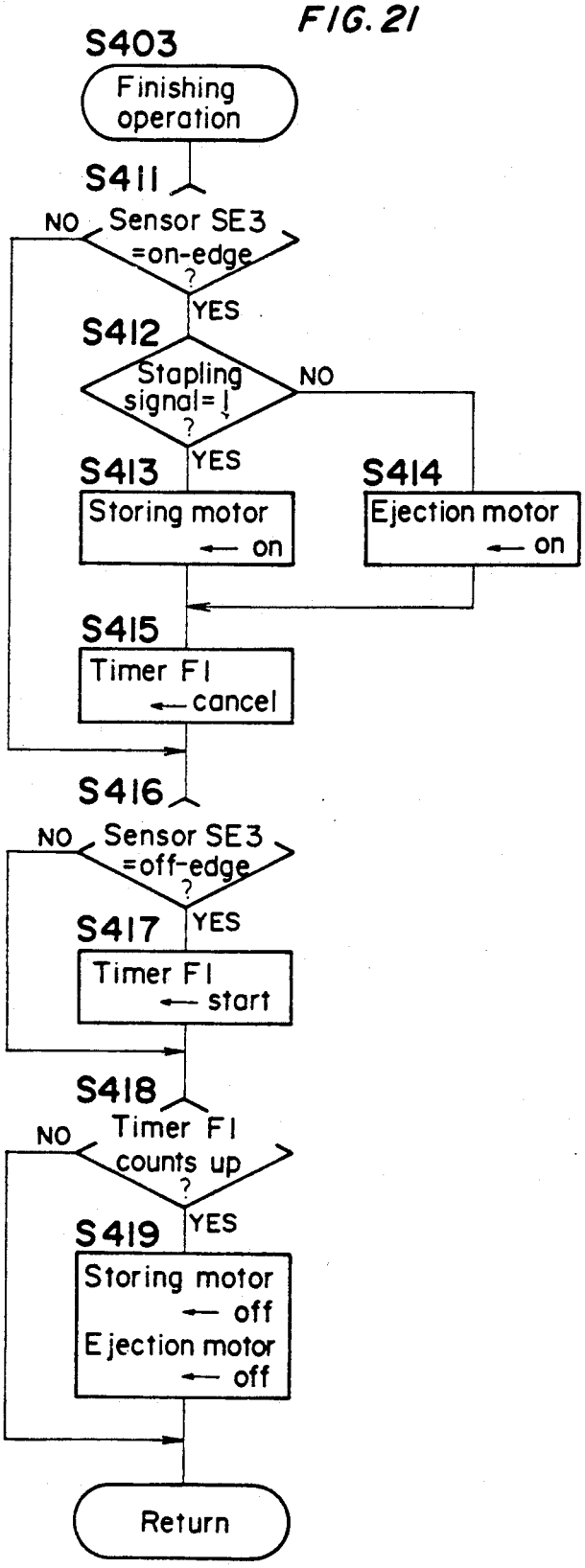
FIG. 21 is a flowchart showing a subroutine for driving a transport motor in the finisher.

FIG. 21 shows a subroutine for driving a transport motor in the finisher 60, which is executed at step S403.

First, at step S411 the ejection sensor SE3 in the copying machine 1 is checked whether on-edge or not. When it is on-edge, which means that the leading edge of a copy sheet is detected by the sensor SE3, the stapling signal is checked whether "1" or not at step S412. When the stapling signal is "1", which means that the stapling mode is selected, at step S413 the storing motor which drives rollers for transporting copy sheets into the stapling tray 65 is turned on. On the other hand, when the stapling signal is "0", which means that the ejection mode is selected, at step S414 an ejection motor which drives rollers for transporting copy sheets onto the sheet tray 67 is turned on. In both cases, the counting of a timer F1 is canceled at step S415. The timer F1 is used for taking the timing of turning off each of the motors, and when copy sheets are to be ejected from the copying machine 1 continuously, the counting of the timer F1 is canceled for the continuous rotation of the motors.

Next, at step S416 the ejection sensor SE3 is checked whether off-edge or not. When it is off-edge, that is, when the trailing edge of a copy sheet is detected by the sensor SE3, the timer F1 is started at step S417. When it is confirmed at step S418 that the timer F1 counts up, at step S419 the motors which were turned on either at step S413 or at step S414 were turned off. Then, this subroutine is completed.

Figure 22A:
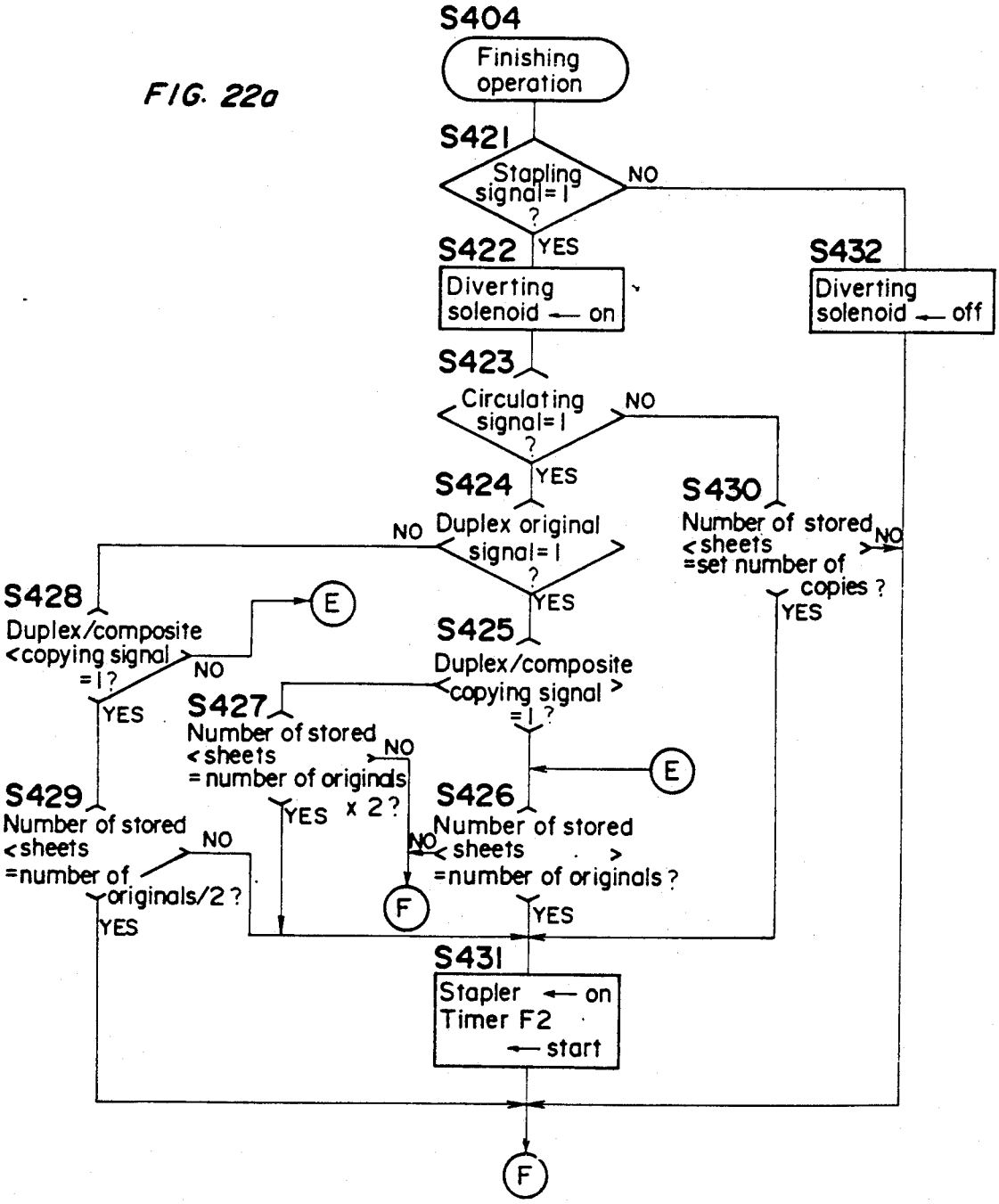
FIGS. 22*a* and 22*b* are flowcharts showing a subroutine for controlling a finishing operation.
Figure 22B:
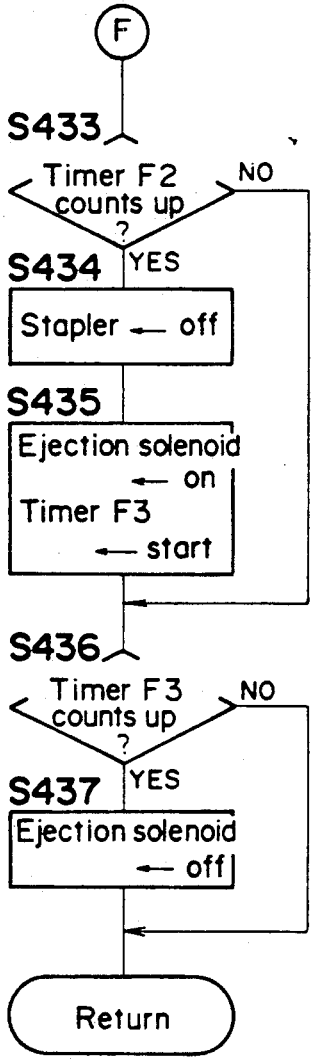

FIGS. 22*a* and 22*b* show a subroutine for stapling copy sheets, which is executed at step S404.

First, at step S421 the stapling signal is checked whether "1" or not. When it is "0", at step S432 the solenoid of the diverting member 62 is kept off so that the diverting member 62 can guide copy sheets to the sheet tray 67, and then the processing goes to step S433. When the stapling signal is "1", the solenoid is turned on at step S422 so that the diverting member 62 can guide copy sheets to the stapling tray 65. Subsequently, the circulating signal is checked whether "1" or not at step S423. When it is "0", which means that the grouping mode is selected (refer to step S35 in FIG. 9), it is checked at step S430 whether or not the number of copy sheets stored in the stapling tray 65 is equal to the number of copies to be made which was set by an operator. When those numbers are the same, at step S431 the stapler 66 is driven, and a timer F2 is started. Thereby, copy sheets stored in the stapling tray 65 are stapled. The timer F2 determines a time for which the motor of the stapler 66 is kept on.

On the other hand, when the circulating signal is "1" at step S423, that is, when the sorting mode is selected (refer to step S38 in FIG. 9), the duplex original signal is checked whether "1" or not at step S424, and the duplex/composite copying signal is checked whether "1" or not at either step S425 or step S428. When the result at step S425 is YES, that is, when duplex originals are being copied in either the duplex copying mode or the composite copying mode, the number of copy sheets stored in the stapling tray 65 is checked whether equal to the number of the originals at step S426, and when the number of copy sheets becomes equal to the number of the originals, the processing goes to step S431. However, when the result ar step S425 is NO, that is, when duplex originals are being copied in the single side copying mode, it is checked at step S427 whether or not the number of copy sheets stored in the stapling tray 65 is two times of the number of the originals. When the number of copy sheets becomes double the originals, the processing goes to step S431. Further, when the result at step S428 is YES, that is, when single side originals are being copied in either the duplex copying mode or the composite copying mode, it is checked at step S429 whether the number of copy sheets stored in the stapling tray 65 is half of the number of the originals. When the number of copy sheets becomes half the originals, the processing goes to step S431. When the result at step S428 is NO, that is, when single side originals are being copied in the single side copying mode, the processing goes to step S426. Then, when the number of copy sheets and the number of originals become the same, the processing goes to step S431 to drive the stapler 66.

Copy sheets are stapled when conditions are fulfilled according to the operation mode as described above. Thereafter, when it is confirmed at step S433 that the timer F2 counts up, at step 434 the stapler 66 is turned off. Then, at step S435 an ejection solenoid of the bottom stopper 65*a* of the stapling tray 65 is turned on in order to open the bottom of the tray 65, and a timer F3 is started. Thereby, the bundle of copy sheets falls into the stack box 69. Then, at step S437 the ejection solenoid is turned off to close the bottom of the stapling tray 65, and this subroutine is completed.

Although the present invention has been described in connection with the preferred embodiment thereof, it is to be noted that various changes and modifications are apparent to those who are skilled in the art. Such changes and modifications are to be understood as included within a scope of the appended claims, unless they are apart therefrom.

What is claimed is:

1. A copying apparatus comprising:

means for feeding a plurality of originals one alter another to an exposure section where each original is exposed to light from irradiating means, which is operated either in a first original feeding mode wherein each original is fed to the exposure section with its first side facing the irradiating means or in a second original feeding mode wherein each original is fed to the exposure section with its first side facing the irradiating means and again placed to the exposure section with its second side facing the irradiating means;

means for forming an image of each original fed to the exposure section on a copy sheet, which is operated either in a first copying mode wherein one copy sheet is subjected to one image forming operation or in a second copying mode wherein one copy sheet is subjected to a plurality of image forming operations;

means for selecting the first original feeding mode or the second original feeding mode as the original feeding mode and selecting the first copying mode or the second copying mode as the copying mode;

means for collecting copy sheets and binding them;

means for counting originals placed on the original feed means;

means for setting a standard depending on combination of the original feeding mode with the copying mode; and control means for inhibiting the operation of the binding means when the value counted by the counting means is over the standard.

2. A copying apparatus as claimed in claim 1, wherein supposing the number of times of image forming operations to which one copy sheet is subject to be "M", and the stapling capacity of the stapling means to be "N", the standard setting means sets the standard at "N" when the first original feeding mode and the first copying mode are selected, sets the standard at "N×M" when the first original feeding mode and the second copying mode are selected, sets the standard at "N/2" when the second original feeding mode and the first copying mode are selected, and sets the standard at "N×M/2" when the second original feeding mode and the second copying mode are selected.

3. A method of controlling a copying apparatus which comprises a platen glass, a circulating type of automatic document feeder for feeding a plurality of originals placed on an original set section onto the platen glass one by one and returning each original to the original set section after image exposure, means for forming an image of each original fed to the platen glass onto a copy sheet, and means for collecting copy sheets and binding them, said method comprising the steps of:

operating the original feed means before operating the image forming means;

counting the number of originals prior to forming an image of each original;

forming an image of each original which is fed onto the platen glass by the original feed means again after the original counting operation onto a copy sheet;

operating the binding means, when the value counted by the counting means is under a specified standard;

inhibiting the operation of the binding means, when the value counted by the counting means is over the standard;

selecting an operation mode of the original feed means;

selecting an operation mode of the copying means; and selecting a standard from alternatives according to the combination of the selected operation modes.

* * * * *